US009408455B2

(12) United States Patent
Py

(10) Patent No.: US 9,408,455 B2
(45) **Date of Patent: *Aug. 9, 2016**

(54) CONTAINER AND VALVE ASSEMBLY FOR STORING AND DISPENSING SUBSTANCES, AND RELATED METHOD

(75) Inventor: Daniel Py, Larchmont, NY (US)

(73) Assignee: MedInstill Development, LLC, New Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/701,194

(22) Filed: Feb. 5, 2010

(65) Prior Publication Data

US 2010/0140290 A1 Jun. 10, 2010

Related U.S. Application Data

(63) Continuation of application No. 11/938,103, filed on Nov. 9, 2007, now Pat. No. 8,672,195, which is a continuation of application No. 10/976,349, filed on Oct. 28, 2004, now Pat. No. 7,637,401, which is a (Continued)

(51) Int. Cl.
*B67B 7/00* (2006.01)
*B65D 5/72* (2006.01)
(Continued)

(52) U.S. Cl.
CPC ..... *A45D 40/26* (2013.01); *B65D 35/06* (2013.01); *B65D 35/08* (2013.01); *B65D 35/38* (2013.01); *B65D 47/205* (2013.01); *B65D 83/0055* (2013.01)

(58) Field of Classification Search
CPC ..... A45D 40/26; B65D 35/06; B65D 35/08; B65D 35/38; B65D 47/205; B65D 83/0055
USPC ..... 222/92–107, 491–497, 490; 251/335.1, 251/336
See application file for complete search history.

(56) References Cited

U.S. PATENT DOCUMENTS 1,392,600 A 10/1921 Rose
1,471,091 A 10/1923 Bessesen
(Continued)

FOREIGN PATENT DOCUMENTS

CN 2436454 6/2001
EP 0 172 711 2/1986
(Continued)

OTHER PUBLICATIONS

Supplementary European Search Report mailed Mar. 14, 2008 in European Application No. 01 987 242.
(Continued)

*Primary Examiner* — Patrick M Buechner
(74) *Attorney, Agent, or Firm* — McCarter & English, LLP

(57) ABSTRACT

A device and method for aseptically storing and dispensing a liquid. The device has container forming a variable-volume storage chamber, and a one-way valve coupled in fluid communication with the storage chamber and having an elastic valve member forming a normally closed valve opening. The valve member is movable between a normally closed position, and an open position with at least a segment of the elastic valve member spaced radially away from the closed position to allow the passage of fluid from the storage chamber through the valve opening. The liquid is maintained hermetically sealed in the storage chamber with respect to ambient atmosphere throughout dispensing multiple portions of the liquid from the storage chamber through the one-way valve.

68 Claims, 28 Drawing Sheets

Related U.S. Application Data continuation of application No. 10/640,500, filed on Aug. 13, 2003, now Pat. No. 6,892,906.

(60) Provisional application No. 60/403,396, filed on Aug. 13, 2002, provisional application No. 60/442,924, filed on Jan. 27, 2003.

(51) Int. Cl.

| | |
|---|---|
| ***B65D 25/40*** | (2006.01) |
| ***B65D 35/38*** | (2006.01) |
| ***F16K 31/00*** | (2006.01) |
| ***A45D 40/26*** | (2006.01) |
| ***B65D 35/06*** | (2006.01) |
| ***B65D 35/08*** | (2006.01) |
| ***B65D 47/20*** | (2006.01) |
| ***B65D 83/00*** | (2006.01) |

(56) References Cited

U.S. PATENT DOCUMENTS 1,854,458 A 4/1932 De Quincy et al.
2,014,881 A 9/1935 Carlstrom
2,128,035 A 8/1938 Boetel
2,317,270 A 4/1943 Harris
2,471,852 A 5/1949 Bau
2,522,403 A 9/1950 Ross
2,648,334 A 8/1953 Brown et al.
2,687,133 A 8/1954 Schwarz
2,715,980 A 8/1955 Frick
2,751,119 A 6/1956 Manning, Sr.
2,844,285 A 7/1958 Moran
2,951,584 A 9/1960 Bauer
RE24,918 E 1/1961 Mills
3,055,367 A 9/1962 Thorstad
3,123,661 A 3/1964 Roman
3,160,329 A 12/1964 Radic et al.
3,173,579 A 3/1965 Curie et al.
3,180,374 A 4/1965 Muller
3,211,340 A 10/1965 Zander
3,220,611 A 11/1965 Zander
3,231,149 A 1/1966 Yuza
3,353,718 A 11/1967 McLay
3,356,093 A 12/1967 Monahon
3,412,910 A 11/1968 Hahn
3,416,425 A 12/1968 Rigolini
3,499,582 A 3/1970 Berney
3,507,568 A 4/1970 Gordeev
3,554,399 A * 1/1971 Chapman et al. ..... 215/11.6
3,561,644 A 2/1971 Works et al.
3,648,903 A 3/1972 Marchant
3,659,749 A 5/1972 Schwartz
3,662,753 A 5/1972 Tassell
3,669,323 A 6/1972 Harker et al.
3,699,961 A 10/1972 Szpur
3,729,032 A 4/1973 Tischlinger et al.
3,756,729 A 9/1973 Tufts
3,820,689 A 6/1974 Cocita
3,838,689 A 10/1974 Cohen
3,921,333 A 11/1975 Clendinning et al.
3,963,814 A 6/1976 Cospen et al.
3,987,938 A 10/1976 Cooprider et al.
3,993,069 A 11/1976 Buckles et al.
4,002,516 A 1/1977 Gaborieau et al.
4,015,752 A 4/1977 Meuresch et al.
4,023,607 A 5/1977 Jensen et al.
4,050,459 A 9/1977 Sanchez
4,078,705 A 3/1978 Butcher
4,099,651 A 7/1978 Von Winckelmann
4,102,476 A 7/1978 Loeffler
4,128,349 A 12/1978 Del Bon
4,132,334 A 1/1979 Danks
4,137,930 A 2/1979 Scholle
4,141,474 A 2/1979 Nilson
4,168,020 A 9/1979 Benson
4,185,628 A 1/1980 Kopfer
4,189,065 A 2/1980 Herold
4,216,236 A 8/1980 Mueller et al.
4,233,262 A 11/1980 Curto
4,239,132 A 12/1980 Mueller et al.
4,240,465 A 12/1980 Rader
4,249,675 A 2/1981 Nilson
4,256,242 A 3/1981 Christine
4,264,018 A 4/1981 Warren
4,314,654 A 2/1982 Gaubert
4,346,708 A 8/1982 LeVeen et al.
4,349,133 A 9/1982 Christine
4,349,134 A * 9/1982 Schuster et al. ..... 222/212
4,366,912 A 1/1983 Matakura et al.
4,367,739 A 1/1983 LeVeen et al.
4,401,239 A 8/1983 Thomassen
4,416,395 A 11/1983 Gaubert
4,420,100 A 12/1983 Mueller
4,425,366 A 1/1984 Sozzi et al.
4,425,698 A 1/1984 Petrie
4,440,316 A 4/1984 Christine
4,457,454 A 7/1984 Meshberg
4,458,830 A 7/1984 Werding
4,475,905 A 10/1984 Himmelstrup
4,479,578 A 10/1984 Brignola et al.
4,479,989 A 10/1984 Mahal
4,482,585 A 11/1984 Ohodaira et al.
4,493,348 A 1/1985 Lemmons
4,493,438 A 1/1985 Rutter
4,501,781 A 2/1985 Kushida et al.
4,513,891 A 4/1985 Hain et al.
4,516,691 A 5/1985 Christine et al.
4,520,948 A 6/1985 Hampel et al.
4,526,294 A 7/1985 Hirschmann et al.
4,561,571 A 12/1985 Chen
4,578,295 A 3/1986 Jabarin
4,579,757 A 4/1986 Su et al.
4,602,725 A 7/1986 Malpas et al.
4,603,066 A 7/1986 Jabarin
4,603,793 A 8/1986 Stern
4,607,764 A 8/1986 Christine
4,624,594 A 11/1986 Sasaki et al.
4,636,412 A 1/1987 Field
4,643,723 A 2/1987 Smit
4,660,737 A 4/1987 Green et al.
4,667,854 A 5/1987 McDermott et al.
4,699,300 A 10/1987 Blake
4,700,838 A 10/1987 Falciani et al.
4,704,510 A 11/1987 Matsui
4,722,459 A 2/1988 Goncalves
4,737,148 A 4/1988 Blake
4,739,906 A 4/1988 LoTurco
4,747,834 A 5/1988 Prindle
4,760,937 A * 8/1988 Evezich ..... 222/95
4,776,495 A 10/1988 Vignot
4,776,717 A 10/1988 Iizuka et al.
4,784,652 A 11/1988 Wikström
4,795,063 A 1/1989 Sekiguchi et al.
4,823,990 A 4/1989 Roggenburg et al.
4,830,229 A 5/1989 Ball
4,842,165 A 6/1989 Van Coney
4,854,481 A 8/1989 Bohl et al.
4,854,483 A 8/1989 Haggart
4,854,486 A 8/1989 Daley et al.
4,859,513 A 8/1989 Gibbons et al.
4,865,591 A 9/1989 Sams
4,880,675 A 11/1989 Mehta
4,895,279 A 1/1990 Schultz
4,903,741 A 2/1990 Ibanez
4,910,147 A 3/1990 Bacehowski et al.
4,921,733 A 5/1990 Gibbons et al.
4,923,480 A 5/1990 Monestere
4,936,833 A 6/1990 Sams
4,949,877 A 8/1990 Hanna et al.
4,962,868 A 10/1990 Borchard
4,964,540 A 10/1990 Katz
4,973,318 A 11/1990 Holm et al.
4,978,036 A 12/1990 Burd

(56) References Cited

U.S. PATENT DOCUMENTS 4,981,479 A 1/1991 Py
5,025,957 A * 6/1991 Ranalletta et al. ..... 222/189.09
5,033,647 A 7/1991 Smith et al.
5,074,440 A 12/1991 Clements et al.
5,083,416 A 1/1992 Schneider et al.
5,099,885 A 3/1992 Nilsson
5,100,027 A 3/1992 Gueret
5,102,705 A 4/1992 Yammoto et al.
5,108,007 A 4/1992 Smith et al.
5,143,236 A 9/1992 Gueret
5,145,083 A 9/1992 Takahashi
5,176,510 A 1/1993 Nilsson
5,178,300 A 1/1993 Haviv et al.
5,197,638 A 3/1993 Wood
5,226,568 A * 7/1993 Newton et al. ..... 222/212
5,226,895 A 7/1993 Harris
5,238,150 A 8/1993 Williams
5,238,153 A 8/1993 Castillo et al.
5,244,465 A 9/1993 Michel
5,253,785 A 10/1993 Haber et al.
5,257,696 A 11/1993 Greene
5,263,946 A 11/1993 Klug
5,267,986 A 12/1993 Py
5,271,513 A 12/1993 Crosnier et al.
5,277,342 A 1/1994 Dickau et al.
5,290,260 A 3/1994 Stines
5,303,851 A 4/1994 Libit et al.
5,318,204 A 6/1994 Davis et al.
5,320,256 A 6/1994 Wood
5,320,845 A 6/1994 Py
5,332,121 A 7/1994 Schmidt et al.
5,337,775 A 8/1994 Lane et al.
5,339,972 A 8/1994 Crosnier et al.
5,360,145 A 11/1994 Gueret
5,366,108 A 11/1994 Darling
5,401,259 A 3/1995 Py
5,409,142 A 4/1995 Wenmaekers et al.
5,409,146 A 4/1995 Hazard et al.
5,416,303 A 5/1995 Grooms et al.
5,419,465 A 5/1995 Schroeder
5,425,465 A 6/1995 Healy
5,429,254 A 7/1995 Christine
5,435,463 A 7/1995 Hodgson
5,452,826 A 9/1995 Stern
5,453,096 A 9/1995 Lataix
5,454,488 A 10/1995 Geier
5,464,125 A 11/1995 Daansen
5,489,026 A 2/1996 D'Aloia
5,489,027 A 2/1996 Goerigk
5,492,252 A 2/1996 Gueret
RE35,187 E 3/1996 Gortz
5,497,910 A 3/1996 Meadows et al.
5,499,758 A 3/1996 McCann et al.
D368,774 S 4/1996 Py
5,505,341 A 4/1996 Gueret
5,545,147 A 8/1996 Harris
5,556,678 A 9/1996 Jupin et al.
D374,719 S 10/1996 Py
5,562,960 A 10/1996 Sugiura et al.
5,564,596 A 10/1996 Meadows et al.
5,565,160 A 10/1996 Makuuchi et al.
5,582,330 A 12/1996 Iba
5,582,598 A 12/1996 Chanoch
5,591,136 A 1/1997 Gabriel
5,609,273 A 3/1997 Firestone et al.
5,613,517 A 3/1997 Handler
5,613,957 A 3/1997 Py
5,615,795 A 4/1997 Tipps
5,617,976 A 4/1997 Gueret
5,630,800 A 5/1997 Blank et al.
5,636,930 A 6/1997 Holloway
5,641,004 A 6/1997 Py
5,642,838 A 7/1997 Stoody
5,664,704 A 9/1997 Meadows et al.
5,676,267 A 10/1997 Slat et al.
5,685,869 A 11/1997 Py
5,687,882 A 11/1997 Mueller
5,692,651 A 12/1997 Fuchs
5,697,532 A 12/1997 Wilde et al.
5,702,019 A 12/1997 Grimard
5,718,334 A 2/1998 Demel
5,727,892 A 3/1998 Baudin
5,728,075 A 3/1998 Levander
5,730,322 A 3/1998 Iba et al.
5,738,067 A 4/1998 Landwehr
5,743,441 A 4/1998 Baudin et al.
5,743,889 A 4/1998 Sams
5,746,728 A 5/1998 Py
5,755,269 A 5/1998 Venooker et al.
5,759,218 A 6/1998 Martin et al.
5,772,079 A 6/1998 Gueret
5,772,347 A 6/1998 Gueret
5,779,109 A 7/1998 Gueret
5,780,130 A 7/1998 Hansen et al.
5,785,683 A 7/1998 Szapiro et al.
5,799,837 A 9/1998 Firestone et al.
5,803,311 A 9/1998 Fuchs
5,804,236 A 9/1998 Frisk
5,816,772 A 10/1998 Py
5,823,397 A 10/1998 Gil
5,829,901 A 11/1998 Brown et al.
5,836,484 A 11/1998 Gerber
5,855,302 A 1/1999 Fisscher
5,857,595 A 1/1999 Nilson
5,860,755 A 1/1999 Bunk
5,875,931 A 3/1999 Py
5,875,936 A 3/1999 Turbett et al.
5,876,372 A 3/1999 Grabenkort et al.
5,879,095 A 3/1999 Gueret
5,879,336 A 3/1999 Brinon
5,899,624 A 5/1999 Thompson
5,906,597 A * 5/1999 McPhee ..... 604/246
5,921,989 A 7/1999 Deacon et al.
5,931,386 A 8/1999 Jouillat
5,934,500 A 8/1999 Cogger et al.
5,934,509 A 8/1999 Niss
5,944,702 A 8/1999 Py
5,971,224 A 10/1999 Garibaldi
RE36,410 E 11/1999 Meshberg
5,983,905 A 11/1999 Patching
5,996,845 A 12/1999 Chan
6,003,733 A 12/1999 Wheeler
6,004,298 A 12/1999 Levander
6,024,252 A 2/2000 Clyde
6,032,101 A 2/2000 Freedman et al.
6,033,384 A 3/2000 Py
6,050,444 A 4/2000 Sugg
6,053,370 A 4/2000 Ludbrook et al.
6,053,893 A 4/2000 Bucher
6,062,430 A 5/2000 Fuchs
6,062,437 A 5/2000 Mascitelli
6,083,201 A 7/2000 Skinkle
6,083,450 A 7/2000 Safian
6,092,695 A 7/2000 Loeffler
6,145,707 A 11/2000 Baudin
6,149,957 A 11/2000 Mandralis et al.
6,170,705 B1 1/2001 Schneider et al.
6,170,715 B1 1/2001 Evans
RE37,047 E 2/2001 Py
6,182,698 B1 2/2001 Barak
6,186,686 B1 2/2001 Neuner et al.
6,193,698 B1 2/2001 Kirchhofer et al.
6,200,047 B1 3/2001 Holloway
6,202,901 B1 3/2001 Gerber et al.
6,216,916 B1 4/2001 Maddox et al.
6,234,363 B1 5/2001 Stradella
6,254,579 B1 7/2001 Cogger et al.
6,267,768 B1 7/2001 Deacon et al.
6,280,421 B1 8/2001 Kirchhofer et al.
6,283,976 B1 9/2001 Portney
6,290,679 B1 9/2001 Hostettler et al.
6,301,767 B1 10/2001 Granger et al.
6,306,423 B1 10/2001 Donovan et al.
6,312,708 B1 11/2001 Donovan

(56) References Cited

U.S. PATENT DOCUMENTS

| | | | |
|---|---|---|---|
| 6,325,253 | B1 | 12/2001 | Robinson |
| 6,338,442 | B1 | 1/2002 | De Laforcade |
| 6,343,713 | B1 | 2/2002 | Abplanalp |
| 6,351,924 | B1 | 3/2002 | Gustafsson et al. |
| 6,357,945 | B1 | 3/2002 | Losier et al. |
| 6,371,129 | B1 | 4/2002 | Le Bras-Brown et al. |
| 6,383,167 | B2 | 5/2002 | Kirchhofer et al. |
| 6,383,509 | B1 | 5/2002 | Donovan et al. |
| 6,386,395 | B1 | 5/2002 | Lunghetti |
| 6,419,412 | B1 | 7/2002 | Ostrowski et al. |
| 6,428,545 | B2 | 8/2002 | Portney |
| 6,446,844 | B1 | 9/2002 | Gross |
| 6,450,994 | B1 | 9/2002 | Boyles et al. |
| 6,455,093 | B1 | 9/2002 | Furrer et al. |
| 6,471,095 | B1 | 10/2002 | Cann |
| 6,485,470 | B2 | 11/2002 | Hostettler et al. |
| 6,491,189 | B2 | 12/2002 | Friedman |
| 6,502,725 | B1 | 1/2003 | Alexander |
| 6,524,287 | B1 | 2/2003 | Cogger |
| 6,533,482 | B1 | 3/2003 | Byun |
| 6,547,108 | B2 | 4/2003 | Johanson |
| 6,561,383 | B1 | 5/2003 | Reddy et al. |
| 6,581,805 | B2 | 6/2003 | Conboy et al. |
| 6,592,918 | B2 | 7/2003 | Kaeser |
| 6,592,922 | B2 | 7/2003 | Furrer et al. |
| 6,604,561 | B2 | 8/2003 | Py |
| 6,662,977 | B2 | 12/2003 | Gerber et al. |
| 6,695,173 | B1 | 2/2004 | Fontana |
| 6,698,628 | B2 | 3/2004 | Mascitelli |
| 6,742,680 | B2 | 6/2004 | Friedman |
| 6,755,327 | B1 | 6/2004 | Hazard et al. |
| D493,366 | S | 7/2004 | Rackwitz |
| 6,761,286 | B2 | 7/2004 | Py et al. |
| 6,769,627 | B2 | 8/2004 | Carhuff et al. |
| 6,802,436 | B2 | 10/2004 | Drennow et al. |
| 6,883,222 | B2 | 4/2005 | Landau |
| 6,892,906 | B2 | 5/2005 | Py et al. |
| 6,962,275 | B2 | 11/2005 | deCler et al. |
| 6,971,553 | B2 | 12/2005 | Brennan et al. |
| 6,997,219 | B2 | 2/2006 | Py et al. |
| 7,000,806 | B2 | 2/2006 | Py et al. |
| 7,011,233 | B2 | 3/2006 | Drennow |
| 7,114,635 | B2 | 10/2006 | Yamada |
| 7,278,553 | B2 | 10/2007 | Py et al. |
| 7,322,491 | B2 | 1/2008 | Py et al. |
| 7,328,729 | B2 | 2/2008 | Py et al. |
| 7,357,335 | B2 | 4/2008 | Laidler et al. |
| 7,513,395 | B2 | 4/2009 | Labinski et al. |
| 7,678,089 | B2 | 3/2010 | Py et al. |
| 7,789,269 | B2 | 9/2010 | Pritchard |
| 7,806,301 | B1 | 10/2010 | Ciavarella et al. |
| 7,861,750 | B2 | 1/2011 | Py et al. |
| 8,240,521 | B2 | 8/2012 | Py |
| 8,408,426 | B2 | 4/2013 | Bakhos |
| 2001/0009990 | A1 | 7/2001 | Hostettler et al. |
| 2001/0027827 | A1 | 10/2001 | Jeannin et al. |
| 2002/0017294 | A1 | 2/2002 | Py |
| 2002/0050301 | A1 | 5/2002 | Jeannin et al. |
| 2002/0071708 | A1 | 6/2002 | Fontanet et al. |
| 2002/0074362 | A1 | 6/2002 | Py et al. |
| 2002/0121527 | A1 | 9/2002 | Good |
| 2002/0124907 | A1 | 9/2002 | Crossdale et al. |
| 2003/0012858 | A1 | 1/2003 | Furrer et al. |
| 2003/0082070 | A1 | 5/2003 | Liberto et al. |
| 2003/0089743 | A1 | 5/2003 | Py et al. |
| 2004/0011820 | A1 | 1/2004 | Abergel et al. |
| 2004/0112925 | A1 | 6/2004 | Py et al. |
| 2004/0118291 | A1 | 6/2004 | Carhuff et al. |
| 2004/0194811 | A1 | 10/2004 | Carhuff et al. |
| 2005/0029307 | A1 | 2/2005 | Py et al. |
| 2005/0072480 | A1 | 4/2005 | Brandes |
| 2005/0089358 | A1 | 4/2005 | Py et al. |
| 2005/0165368 | A1 | 7/2005 | Py et al. |
| 2005/0260090 | A1 | 11/2005 | Stark et al. |
| 2006/0169722 | A1 | 8/2006 | Py et al. |
| 2006/0186139 | A1 | 8/2006 | Laidler et al. |
| 2007/0255228 | A1* | 11/2007 | Secondo ..... 604/246 |
| 2009/1022400 | | 9/2009 | Bakhos |
| 2011/1029767 | | 12/2011 | Py et al. |
| 2012/1011189 | | 5/2012 | Bakhos |
| 2013/1021400 | | 8/2013 | Bakhos |

FOREIGN PATENT DOCUMENTS

| | | | |
|---|---|---|---|
| EP | 0 616 141 | | 9/1994 |
| EP | 0 733 559 | | 9/1996 |
| EP | 0 743 263 | | 11/1996 |
| EP | 0 802 827 | | 8/1998 |
| EP | 0 649 795 | | 6/1999 |
| EP | 0 673 852 | | 2/2000 |
| FR | 2 709 733 | | 3/1995 |
| JP | 52-91345 | A1 | 7/1977 |
| JP | S59-10986 | | 4/1984 |
| JP | S62-52169 | U | 4/1987 |
| JP | H2-21078 | | 6/1990 |
| JP | 2-111636 | U | 9/1990 |
| JP | 2-102940 | | 5/1992 |
| JP | H04-189782 | A | 7/1992 |
| JP | 06-239379 | | 7/1994 |
| JP | 07-125799 | | 5/1995 |
| JP | 10-156269 | | 6/1998 |
| JP | 11-268778 | A | 10/1999 |
| JP | 2001-72092 | A | 3/2001 |
| JP | 2002-347812 | | 4/2002 |
| JP | 05-016950 | | 1/2003 |
| WO | WO85/03062 | | 7/1985 |
| WO | WO 93/16955 | | 9/1993 |
| WO | WO 99/32185 | | 1/1999 |
| WO | WO 99/41158 | | 8/1999 |
| WO | WO 00/29192 | | 5/2000 |
| WO | WO 02/40122 | | 5/2002 |

OTHER PUBLICATIONS

Supplementary European Search Report mailed Dec. 18, 2008 in European Application No. 03 779 166.

* cited by examiner 800
803
808
810
812
814
817
826
840
860
862
864
867

CONTAINER AND VALVE ASSEMBLY FOR STORING AND DISPENSING SUBSTANCES, AND RELATED METHOD

This patent application is a continuation of co-pending U.S. patent application Ser. No. 11/938,103, filed Nov. 9, 2007 now U.S. Pat. No. 8,672,195, entitled "Device with Chamber and First and Second Valves in Communication Therewith, and Related Method," which is a continuation of U.S. patent application Ser. No. 10/976,349, filed Oct. 28, 2004, entitled "Container and Valve Assembly for Storing and Dispensing Substances, and Related Method," now U.S. Pat. No. 7,637,401, which is a continuation of U.S. patent application Ser. No. 10/640,500, filed Aug. 13, 2003, entitled "Container and Valve Assembly for Storing and Dispensing Substances, and Related Method," now U.S. Pat. No. 6,892,906, and claims priority under 35 U.S.C. §119(e) to U.S. Provisional Patent Application No. 60/403,396, filed Aug. 13, 2002, entitled "Container for Storing and Dispensing Substances and Method of Making Same", and to U.S. Provisional Patent Application No. 60/442,924, filed Jan. 27, 2003, entitled "Container and Valve Assembly for Storing and Dispensing Substances", all of which are hereby expressly incorporated by reference in their entireties as part of the present disclosure.

BACKGROUND OF THE INVENTION

1. Field of the Invention

The subject invention relates to containers for dispensing liquid, creamy, pasty or like products, and more particularly, to improved containers including one-way valves and collapsible and/or squeeze bags or tubes that maintain the product in an airless and/or sterile condition during repeated dispensing, and to related methods of making and using such containers and valve assemblies.

2. Background Information

Flexible tubes are used to store a variety of powder, liquid, gel, creamy and pasty products having a broad range of viscosities. Generally, the flexible tubes have a cover which is removed to expose a simple release aperture. As a result, low pressure is required to express the contents therein. Undesirable oozing and collection of product that can clog the release aperture is common. Moreover, when the traditional tube is opened, the contents are not only subject to the environment but a quantity of air is normally sucked into the tube. Hence, despite techniques for sterilizing foodstuffs and other products, even the use of preservatives cannot prevent degradation of many products, thereby limiting the shelf-life and range of products suitable for dispensing via tubes. For tubes which dispense multiple doses, even refrigeration after opening cannot prevent the subsequent degradation of the product. The perishable item still has a limited shelf life. In view of the above, one solution has been to provide sterile servings in smaller, portable quantities, such as individual serving packets of ketchup, mustard and mayonnaise.

Similarly, many cosmetic, dermatological, pharmaceutical and/or cosmeceutical products and other substances are packaged in dispensers or other containers that expose the product to air after opening and/or initially dispensing the product. As a result, such products must include preservatives in order to prevent the product remaining in the container from spoiling or otherwise degrading between usages. In addition, such products typically must be used within a relatively short period of time after opening in order to prevent the product from spoiling or otherwise degrading before use. One of the drawbacks associated with preservatives is that they can cause an allergic or an otherwise undesirable reaction or effect on the user. In addition, the preservatives do not prevent the bulk product stored within the open container from collecting, and in some cases, facilitating the growth of germs. Many such prior art dispensers expose the bulk product contained within the dispenser after opening to air, and thus expose the bulk product to bacteria, germs and/or other impurities during and/or after application of the product, thereby allowing contamination of the product remaining in the dispenser and spreading of the bacteria, germs or impurities with subsequent use of the product. For example, liquid lipstick is particularly poorly suited for dispensing by prior art containers. The liquid lipstick becomes contaminated, evaporates due to air passage losing moisture, and ultimately is unusable if not unsafe before complete utilization of the product. The tips become contaminated, dirty and sticky or crusty as well as allowing the lipstick to continue to flow when not being used.

In view of the above, several containers have been provided with closure devices such as one-way valves. One drawback associated with prior art dispensers including one-way valves is that the valves are frequently designed to work with mechanical pumps or like actuators that are capable of creating relatively high valve opening pressures. Exemplary dispensers of this type are illustrated in U.S. Pat. Nos. RE 37,047, 6,032,101, 5,944,702, and 5,746,728 and U.S. Publication Nos. US2002/0074362 A1, US2002/0017294 A1. Squeeze tube-type dispensers, on the other hand, are not capable of creating the necessary valve opening pressures, and therefore such prior art valves do not work effectively with squeeze tubes.

Accordingly, it is an object of the present disclosure to overcome one or more of the above-described drawbacks and disadvantages of the prior art.

SUMMARY OF THE INVENTION

A currently preferred embodiment of the container or dispenser of the present invention comprises a tube for storing a product. The tube is coupled in fluid communication with a nozzle for dispensing the product from the container. The nozzle acts as a one-way valve for allowing the passage of the product therethrough and preventing the passage of fluids in the opposite direction. The one-way valve is preferably formed by an inner body portion and a flexible cover overlying the inner body portion and creating the one-way valve at the interface of the inner body portion and flexible cover.

In accordance with another aspect of the present invention, a tube and valve assembly for storing and dispensing a substance therefrom includes a tube having a squeezable tubular body defining therein a storage chamber for receiving and storing the substance, and a head located at one end of the tubular body. The head defines a neck and a first axially extending passageway formed therethrough that is coupled in fluid communication with the storage chamber of the tubular body and defines an unobstructed axially extending flow path therebetween. A one-way valve assembly is mounted on the head and includes a valve body having a body base defining a second axially extending passageway coupled in fluid communication with the first axially extending passageway and defining an unobstructed axially extending flow path therebetween. The one-way valve assembly further includes an axially extending valve seat defining a diameter less than a diameter of the body base, a first substantially frusto-conical or tapered portion extending between the body base and the valve seat, and a plurality of flow apertures axially extending through the first portion adjacent to the valve seat and angularly spaced relative to each other. A valve cover is formed of an elastic material defining a predetermined modulus of elasticity, and includes a cover base mounted on the body base and fixedly secured against axial movement relative thereto. The cover base defines a diameter less than a diameter of the body base to thereby form an interference fit therebetween. A valve portion overlies the valve seat and defines a predetermined radial thickness and a diameter less than a diameter of the valve seat to thereby form an interference fit therebetween. The valve portion and valve seat define a normally closed, annular, axially extending valve opening therebetween, and the valve portion is movable radially between a normally closed position with the valve portion engaging the valve seat, and an open position with a segment of the valve portion spaced radially away from the valve seat to allow the passage of substance at a predetermined valve opening pressure therebetween. A second substantially frusto-conical or tapered portion extends between the cover base and valve portion, overlies the first substantially frusto-conical or tapered portion of the body, and forms an interference fit therebetween. At least one of the valve seat diameter, a degree of interference between the valve cover and valve seat, the predetermined radial thickness of the valve portion, and a predetermined modulus of elasticity of the valve cover material, is selected to (i) define a predetermined valve opening pressure generated upon manually squeezing the tube that allows passage of the substance from the storage chamber through the valve opening, and (2) hermetically seal the valve and prevent the ingress of bacteria through the valve and into the tube in the normally closed position.

One advantage of the illustrated embodiments is that the nozzle substantially prevents the ingress of air, other gases or vapors, or bacteria therethrough or otherwise into the tube during dispensing. As a result, the containers may maintain the substances contained therein in a sterile and/or airless condition throughout substantial periods of storage, shelf life and/or use. Accordingly, the containers of the illustrated embodiments are particularly well suited for dispensing multiple doses of sterile and/or non-preserved (or "preservative-free") products or other substances requiring storage in an airless condition.

Another advantage of the illustrated embodiments is that at least one of the valve seat diameter, a degree of interference between the valve cover and valve seat, the predetermined radial thickness of the valve portion, and a predetermined modulus of elasticity of the valve cover material, is selected to (i) define a predetermined valve opening pressure generated upon manually squeezing a tube that allows passage of the substance from the storage chamber through the valve opening, and (2) hermetically seal the valve and prevent the ingress of bacteria through the valve and into the tube in the normally closed position. Accordingly, in contrast to the prior art valves described above, the tube and valve assembly of the illustrated embodiments enables a sufficiently low valve opening pressure to allow the substance to be dispensed through the valve by manually squeezing the tube, yet the valve also hermetically seals the tube and prevents the ingress of bacteria or other impurities into the tube.

Another advantage of the currently preferred embodiments of the present disclosure is that the seal formed by the nozzle substantially prevents any creep of the material during the storage or shelf-life. Another advantage of the one-way valve assembly is that after dispensing the product does not remain in the one-way valve which could cause improper sealing and potential contamination. In addition, the one-way valve employed in the preferred embodiments of the present disclosure further maintains the interior of the tube in a hermetically-sealed condition throughout the storage, shelf-life and/or use of the container.

Yet another advantage of the illustrated embodiments is that because the product may be maintained in an airless condition in the tube, the containers may be used in virtually any orientation, and furthermore, may be used in low gravity environments. Still another advantage is the ability to optimize the valve opening pressure for flow, ease of use and a desired valve opening pressure for products of varying viscosities.

Additionally, the invention herein is scalable which is useful when storing larger quantities of product having an extended shelf life. Another advantage of the currently preferred embodiments of the present disclosure is the flow path is substantially linear which allows for a more consistent flow rate and velocity of the product. The linear flow path also helps to prevent pockets in which a viscous material could become trapped or even create a flow path for a source of contamination.

Other object and advantages of the preferred embodiments of the present invention will become readily apparent in view of the following detailed description taken in conjunction with the accompanying drawings.

BRIEF DESCRIPTION OF THE DRAWINGS

So that those having ordinary skill in the art to which the disclosed invention appertains will more readily understand how to make and use the same, reference may be had to the drawings wherein:

FIG. 15 D illustrates a line drawing of the nozzle of the container of FIG. 9.

DETAILED DESCRIPTION

Figure 1:
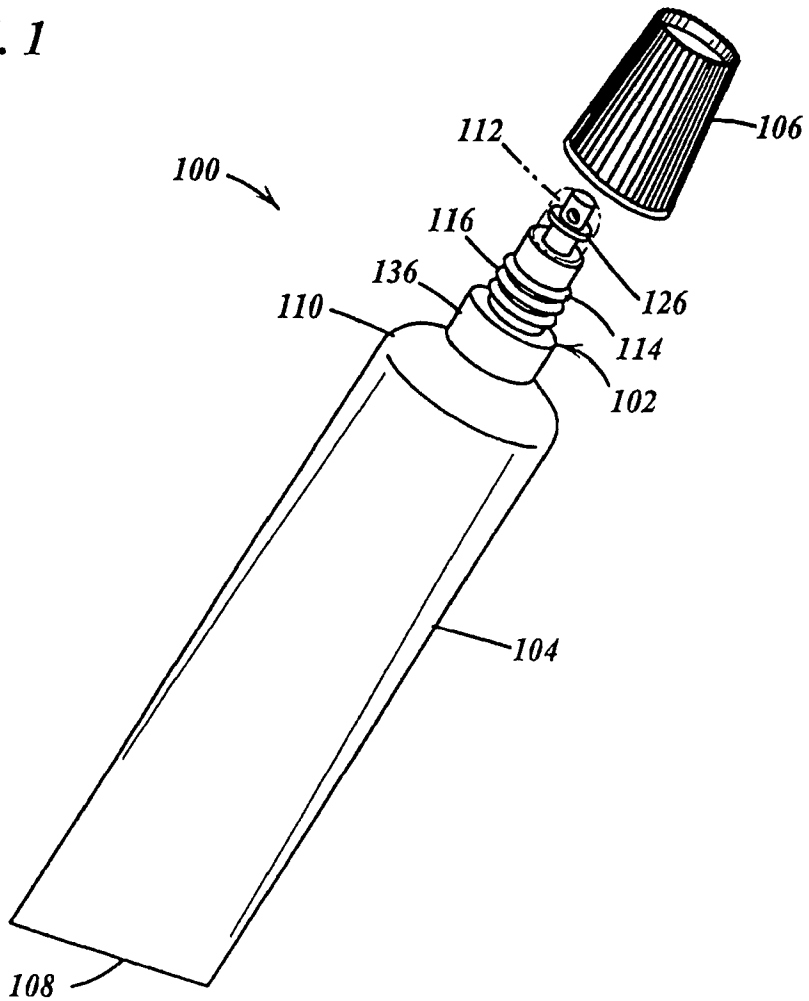
FIG. 1 illustrates a perspective view of a container for storing and releasing a substance from a sterile environment.
Figure 2:
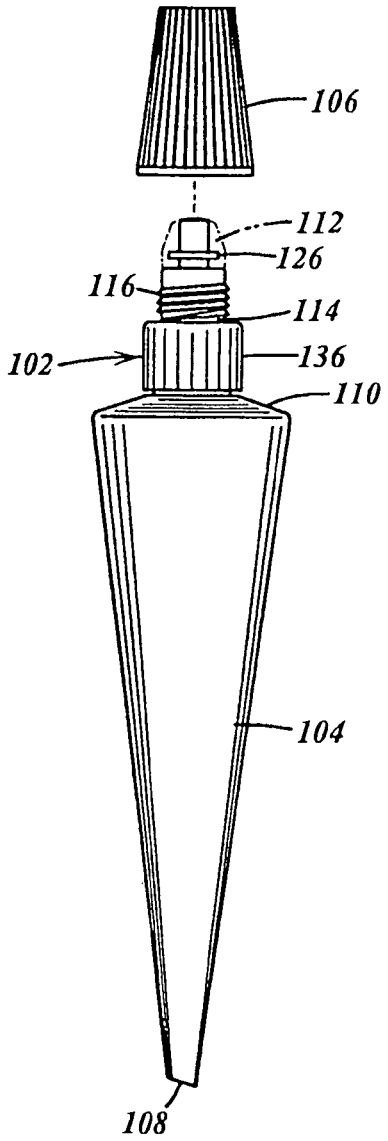
FIG. 2 illustrates a side view of the container of FIG. 1 with the cap removed.

The advantages, and other features of the disclosure herein, will become more readily apparent to those having ordinary skill in the art from the following detailed description of certain preferred embodiments taken in conjunction with the drawings which set forth representative embodiments and wherein like reference numerals identify similar structural elements.

Referring to FIGS. 1-4, a container, is referred to generally by reference numeral 100. The container includes a nozzle 102 and body 104 depending from the nozzle 102. The body 104 defines an interior which retains a creamy, pasty, liquid or other product (not shown) to be dispensed. To make the container 100, the body 104 and nozzle 102 are sterilized, the body 104 is filled with the product, such as a perishable food, cosmetic, household, pharmaceutical, cosmeceutical, medicinal or other product or substance, and the nozzle 102 is attached to seal the contents of the body 104 from the atmosphere. Preferably, after the container 100 is closed, the contents are sterilized by an appropriate method such as gamma radiation and the like as would be appreciated by those of ordinary skill in the pertinent art. However, as may be recognized by those of ordinary skill in the pertinent art based on the teachings herein, the container 100 and the product contained therein can be sterilized, if desired, in any of numerous different ways that are currently or later become known for performing this function. For example, the product can be terminally sterilized, the product can be sterilized prior to filling same into the container, or the product can be in-line sterilized during filling of the container.

A cap 106 threadably engages the nozzle 102 to prevent inadvertent release of the product. In order to dispense the product, the cap 106 is removed and pressure is applied to the body 104 by manually squeezing the body 104 and, in turn, to the nozzle 102 to allow release of the product. The nozzle 102 releases the product without exposing the remaining product to the external atmosphere; thus, the sterility and/or airless condition of the interior of the body 104 is maintained and the shelf life of the product is not decreased. Further, bacteria or other contaminants are prevented from passing through the valve and into the interior of the body 104, as described further below.

Figure 3:
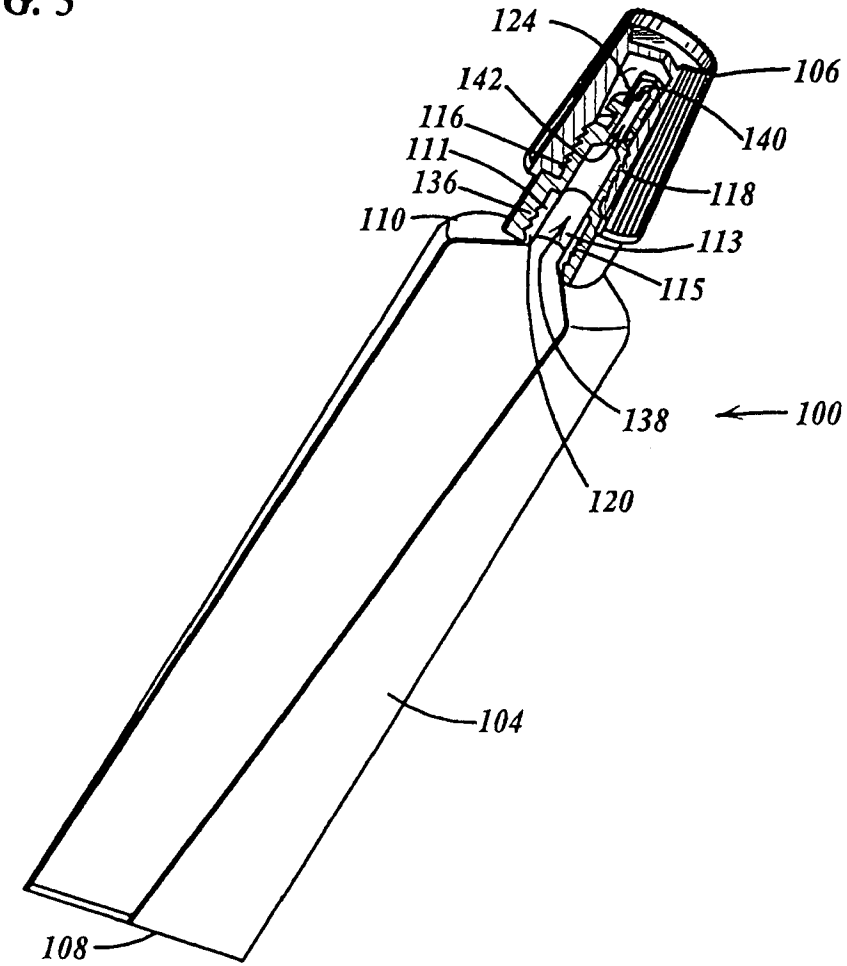
FIG. 3 illustrates a partially broken away, perspective view of the container of FIG. 1.
Figure 4:
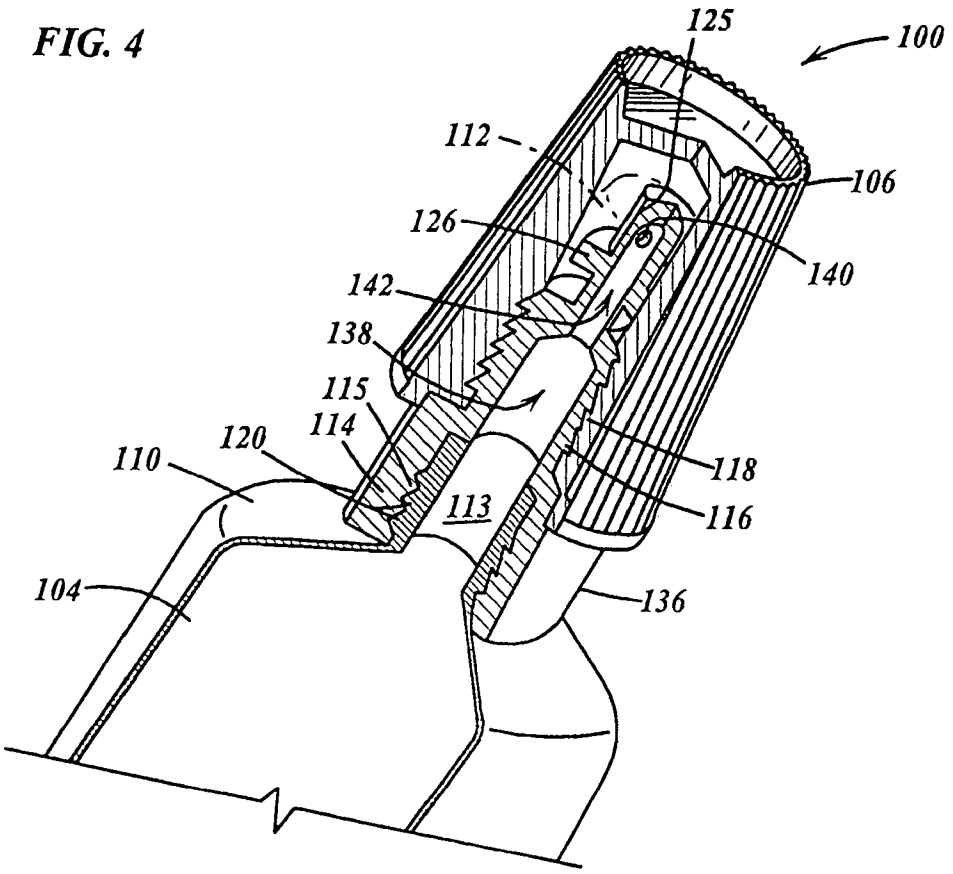
FIG. 4 illustrates an enlarged, partially broken away perspective view of the nozzle of the container of FIG. 1.

The body 104 is a tube with a closed end 108 defining a normally closed seal and an open end 110 for sealingly connecting to the nozzle 102. As shown in FIGS. 3 and 4, the open end 110 has a neck 111 which defines an outlet 113 therethrough for releasing the product. Threads 115 about the circumference of the neck 111 couple the body 104 to the nozzle 102. Preferably, the body 104 is pliable such that a high percentage of the product therein can be easily utilized. The body 104 may be all plastic, aluminum, a combination thereof, and/or a plurality of other suitable materials well known to those skilled in the art now and later discovered. In one embodiment, the body 104 is made from a coextruded sheet containing various combinations of LDPE, LLDPE, HDPE, tie resins and foil. The body 104 can be customized for the application, for example, by color, shape, decoration, coatings and the like. Additionally, the container 100 can be sized to be portable or otherwise as may be desired. The body 104 preferably also provides a barrier to oxygen, moisture, flavor loss and the like.

The product contained within the container may be any of numerous different types of cosmetics, such as eye and lip treatments, including, for example, lip gloss, eye colors, eye glaze, eye shadow, lip color, moisturizers and make-up, such as cover-up, concealer, shine control, mattifying make-up, and line minimizing make-up, personal care items such as lotions, creams and ointments, oral care items such as toothpaste, mouth washes and/or fresheners, pharmaceutical products such as prescription and over-the-counter drugs, dermatological products, such as products for treating acne, rosacea, and pigmentation disorders, cosmeceutical products, such as moisturizers, sunscreens, anti-wrinkle creams, and baldness treatments, nutraceuticals, other over-the-counter products, household items such as adhesives, glues, paints and cleaners, industrial items such as lubricants, dyes and compounds, and food items such as icing, cheese, yoghurt, milk, tomato paste, and baby food, and condiments, such as mustard, ketchup, mayonnaise, jelly and syrup. As may be recognized by those of ordinary skill in the pertinent art based on the teachings herein, this list is intended to be exemplary and in no way limiting.

The cap 106 is preferably made of plastic. Preferably, the cap 106 prevents inadvertent release of the product from the container 100. Additional tamper-evident features can be included to comply with FDA guidelines as would be appreciated by those of ordinary skill in the pertinent art. The container 100 also may be packaged in a box for additional ease of handling and safety.

In order to best understand the operation of the container 100, the structure and operation of the nozzle 102 will now be described in detail. The nozzle 102 is for releasing the product upon application of manual pressure to the body 104 by squeezing the body in a conventional manner, such as squeezing the body on opposites sides relative to each other and, in turn, transmitting a substantially radially-directed force into the body. By squeezing the body, the pressure of the product or other substance contained within the body is increased until the pressure is greater than the valve opening pressure of the nozzle 102 to, in turn, dispense the product within the container through the nozzle. The nozzle 102 includes an outer body or valve cover 112 at a distal end or tip, and an inner body 114 having a distal end or tip defining a valve seat that is coupled to the outer body or valve cover 112. The inner body 114 further defines a proximal end coupled to the body 104. An intermediate portion of the inner body 114 defines circumferential threads 116 for engaging the cap threads 118. The proximal portion of the inner body 114 defines internal threads 120 for engaging the body threads 115.

The outer body or valve cover 112 receives an inner nozzle portion or tip 124 defining the valve seat of the inner body 114. As shown in FIG. 4, the interface of the outer body 112 and the inner nozzle portion 124 defines a seam 125 which is normally closed (i.e., the inner and outer nozzle portions are abutting one another as shown in the drawings), but can be opened by the flow of product of sufficient pressure (i.e., equal to or greater than the valve opening pressure) into the seam 125 to release the product through the nozzle 102. The outer body 112 is preferably molded from a relatively flexible plastic material in comparison to the inner body 114. Thus, the outer body 112 can be flexed relative to the inner nozzle portion 124 to open the seam 125 to release the product through the nozzle 102.

As shown in FIG. 4, the inner body 114 includes an annular flange 126 which fits within a corresponding recess in the outer body 112, for retaining the inner body 114 within the outer body 112 and securing the outer body or valve cover against axial movement. The inner body 114 is therefore pressed into the outer body 112 and coupled to the outer body by guiding the flange 126 into the corresponding recess. The annular flange 126 also substantially prevents undesirable flow of the product between the annular flange 126 and outer body 112. As will be recognized by those skilled in the art, the inner body 114 can be molded as an integral part of the body 104.

As shown in FIGS. 3 and 4, the inner body 114 includes a first substantially cylindrical wall 136 essentially defining a hollow shaft projecting in the axial direction of the container 100 and threadably engaging the distal end of the body 104. The proximal end and intermediate portion of the inner body 114 define a first channel 138 which is sized and configured to align with the outlet 113 of the neck 111. The distal portion of the inner body 114 defines a relatively narrower second channel 142 axially aligned with the first channel 138. A plurality of release apertures 140, in communication with the second channel 142, are defined in a sidewall of the distal portion of the inner body 114 for allowing exit of the product therethrough. In a preferred embodiment, the cross-sectional area of the release apertures 140 is at least about 60% of the total cross-sectional area of the sidewall; although various size release apertures 140, both larger and smaller, may be selected to achieve the desired performance as would be appreciated by those of ordinary skill in the art based upon review of the subject disclosure.

In the operation of the container 100, the container 100 is actuated to release the product through the nozzle 102 by depressing the body 104 by hand. As a result, pressure develops within the body 104, the first channel 138, the second channel 142 and the release apertures 140. The pressure facilitates the flow of product from the body 104 through the seam 125. As a result, the pressurized product flows through the release aperture 140, into the seam 125, and out through the tip of the nozzle 102 for release. As indicated above, the valve opening pressure is sufficiently low so that manually squeezing the body will create sufficient pressure to cause the pressurized product within the container to open the seam 125 and dispense therethrough.

Once the product is released and the pressure upon the body 104 is removed, the seam 125 returns to its normally closed position to substantially prevent any product that is exposed to air from flowing back into the container 100 and otherwise seal the container. The container 100 is then ready to be actuated again to release another amount of product. One advantage of this type of container 100 is that once a dose of product is released, the seam 125 of the nozzle 102 closes, and thus substantially prevents the product which has been exposed to air or foreign particles from passing back through the nozzle 102 and into the container 100, which can, in some instances, contaminate the remainder of the product in the container 100. This advantage is particularly important when storing multiple-dose quantities of sterile and/or preservative-free formulations of medicament, perishable food, cosmetics, and the like.

Figure 4B:
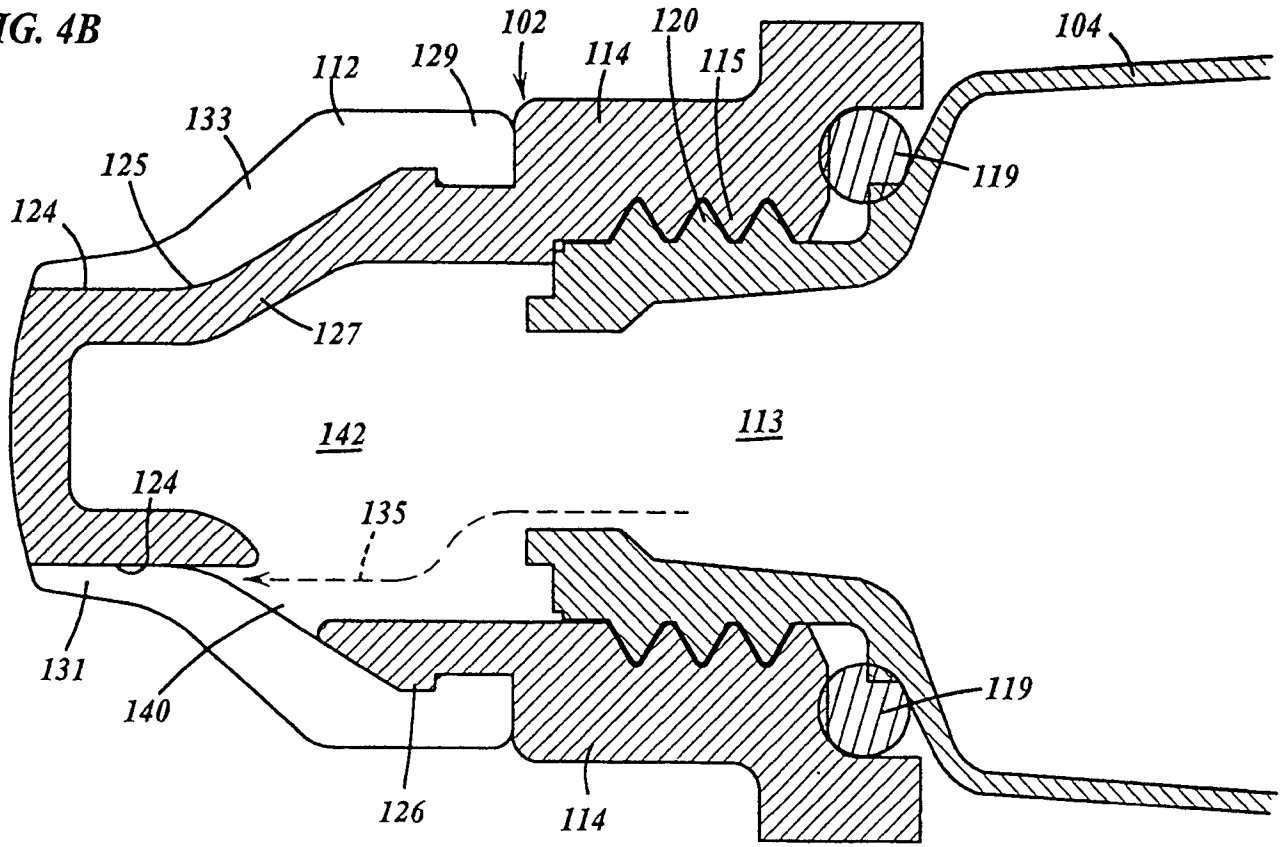
FIG. 4B illustrates a cross-section of another nozzle with an o-ring seal for a container for storing and releasing a substance from a sterile environment.
Figure 5:
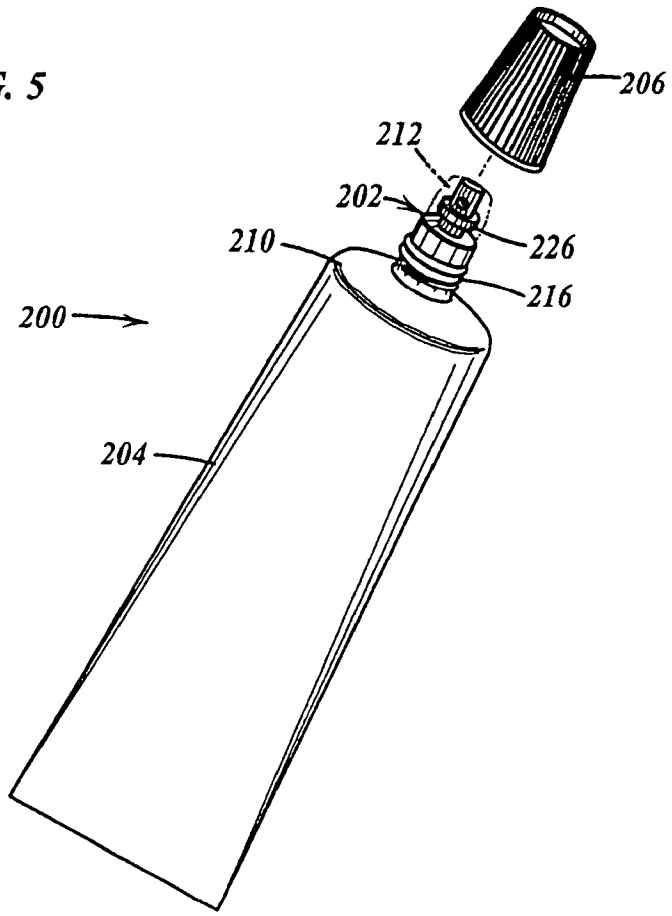
FIG. 5 illustrates a perspective view of another container for storing and releasing a substance from a sterile environment.
Figure 6:
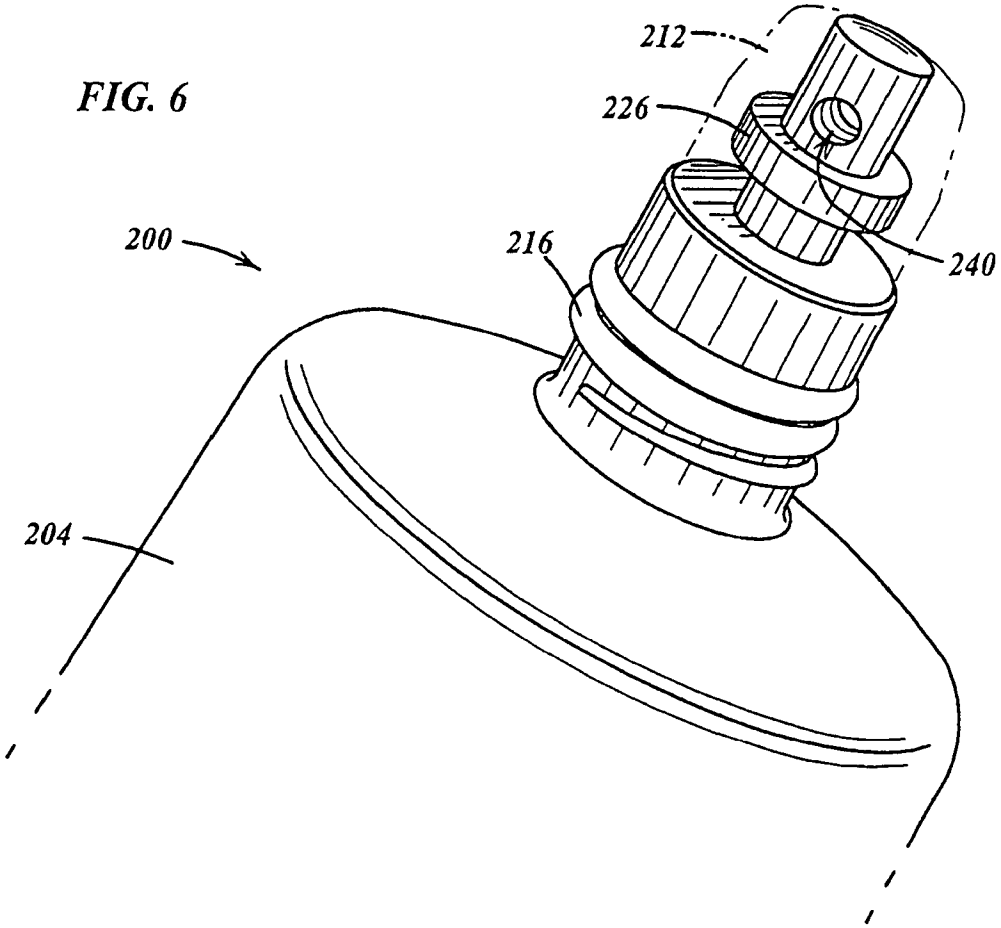
FIG. 6 illustrates a partial, side view of the container of FIG. 5.
Figure 7:
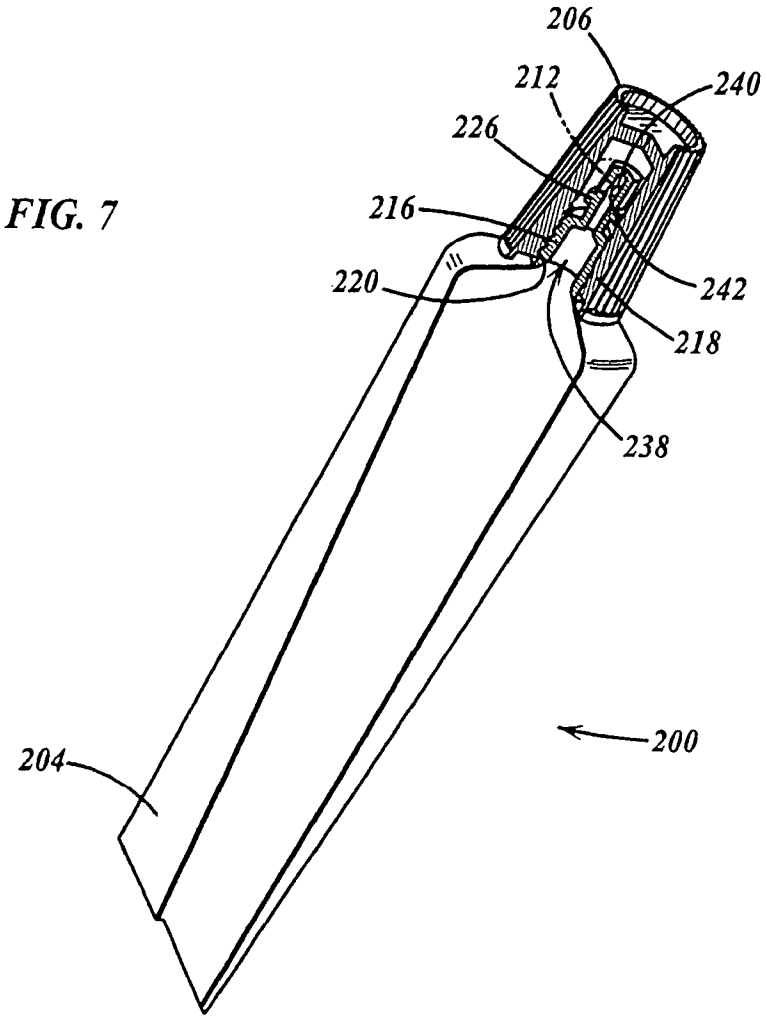
FIG. 7 illustrates a partially broken away, perspective view of the container of FIG. 5.

Referring now to the embodiment of FIG. 4B, an o-ring 119 is included to prevent the product from inadvertently being released between the body 104 and inner body 114. Preferably, the o-ring 119 is seated between the container body 104 and the inner body 114 for forming a hermetic seal therebetween. As can be seen, in this embodiment the nozzle 102 differs from the nozzle described above in that the inner body 114 of the valve assembly includes a first substantially frusto-conical or tapered portion 127 extending between the base of the body and the valve seat 124. Further, the plural flow apertures 140 (only one shown) extend through the tapered portion 127. As can be seen, each flow aperture 140 is formed contiguous to the axially-elongated valve seat 124. The valve cover 112 includes a cover base 129 mounted on the body base and fixedly secured against axial movement relative thereto by the annular flange 126 of the body base being received within the corresponding annular recess of the cover base. A valve portion 131 of the valve cover overlies the valve seat 124. As can be seen, the valve portion 131 defines a predetermined radial thickness and a diameter less than a diameter of the valve seat to thereby form an interference fit therebetween. The valve portion 131 and valve seat 124 define the normally closed, annular, axially extending valve opening 125 therebetween. The valve portion 131 is movable radially between the normally closed position with the valve portion engaging the valve seat, as shown in FIG. 4B, and an open position with a segment of the valve portion spaced radially away from the valve seat to allow the passage of substance at a predetermined valve opening pressure therebetween. The valve cover 112 further defines a second substantially frusto-conical shaped portion 133 extending between the cover base and valve portion 131 that overlies the first substantially frusto-conical shaped portion 127 of the body and forms an interference fit therebetween.

As indicated by the broken line arrow 135 in FIG. 4B, the dispensed product defines an unobstructed, axially extending flow path between the interior of the body 104 and the flow apertures 140. By forming the outlet apertures in the substantially frusto-conical or tapered portion 127 of the inner body, and by forming the radially inner side of each aperture either contiguous to, or substantially contiguous to the annular, axially-extending valve seat 124 as shown, the head loss encountered in dispensing the product from the interior of the container through the flow apertures 140 is substantially minimized, thus facilitating a relatively low valve opening pressure. As a result, the container and valve assembly enables the product to be easily and comfortably dispensed through the nozzle by manually squeezing the tube, yet the valve assembly maintains a hermetic seal that substantially prevents the ingress of bacteria or other unwanted impurities through the valve and into the interior of the container. As described further below, the valve portion 131 and the frusto-conical shaped portion 133 of the valve cover define a tapered cross-sectional profile such that the radial thickness of the cover in these sections progressively decreases in the direction from the interior to the exterior of the valve assembly. As described further below, one advantage of this configuration is that once the product enters the interior end of the seam or valve opening 124, the energy required to successively open the remaining axial segments of the tapered and valve portions 133 and 131 progressively decreases, thus causing substantially all substance that enters the valve opening to be dispensed through the valve opening, and thereby prevent the residual seepage of such substance. As also described further below, and in accordance with the currently preferred embodiments of the disclosure, at substantially any time during the dispensing of product through the valve opening 125, a respective annular segment of the valve portion 131 engages the valve seat 124 to thereby prevent fluid communication between the exterior and the interior of the valve. As a result, the valve assembly preferably continuously maintains the interior of the container hermetically sealed, even during dispensing, thus permitting the container to hold multiple doses of products that must be maintained in a sterile and/or airless condition, such as "preservative-free" formulations. As described further below, the axial extent of the valve seat 124 (i.e., the sealing surface of the valve seat) is made sufficiently long to ensure that this objective can be achieved.

Turning to FIGS. 5-8, another embodiment of the present disclosure is indicated generally by the reference numeral 200. The container 200 is substantially the same as the container 100 described above, and therefore like reference numerals preceded by the numeral "2" instead of the numeral "1", are used to indicate like elements whenever possible. The primary difference of the container 200 in comparison to the container 100 is that the inner portion 202 is integral with the body 104 thereby eliminating the need for a neck and distinct inner portion.

To manufacture the container 200, plastic pellets are melted while passing through an extruder. The extruder may thereby produce a single layer or a multiple layer continuous sleeve. The sleeve is cut to a desired length to form the body 204. The headless body 204 is loaded onto a mandrel where the inner body 214 is injected, compression molded or welded thereto, as is known to those of ordinary skill in the pertinent art. At this time, silk screening or additional printing may be applied to the external surface of the body. The body 204 is then filled with the selected product and the outer body 212 is coupled to the inner body 214 to seal the container 200.

To fill the container 200, a filling machine may be provided in a sterile environment. A variety of filling machines are available and an exemplary one is the liquid filler available from Pack West of 4505 Little John St., Baldwin Park, Calif. 91706. The product may be injected into the body 204 before or after the nozzle 202 is in place. After sealing with the outer body 212, the cap 206 is then applied. Preferably, the cap 206 prevents inadvertent release of the product during handling.

In an alternate filling method, a sterile environment is not required even though the product needs to be maintained in a sterile environment. Filling may include injecting a sterilizing agent such as liquid hydrogen peroxide at a pressure above atmospheric into containers made of polyethylene terephthalate or other suitable material for sterilization thereof. To remove the sterilizing agent, a stream of hot sterile air can hasten evaporation thereof. Then, the sterile product can fill the container and displace the hot air until a portion of the sterile fluid can be suctioned away to insure the entire contents are sterile. At such time, the proper closure in the form of a sterilized nozzle can be applied. For further examples of acceptable filling methods and apparatus, the container may be filled in accordance with the teachings of U.S. Pat. No. 6,351,924, U.S. Pat. No. 6,372,276 and/or U.S. Pat. No. 6,355,216, each of which is incorporated herein by reference in its entirety.

Figure 8:
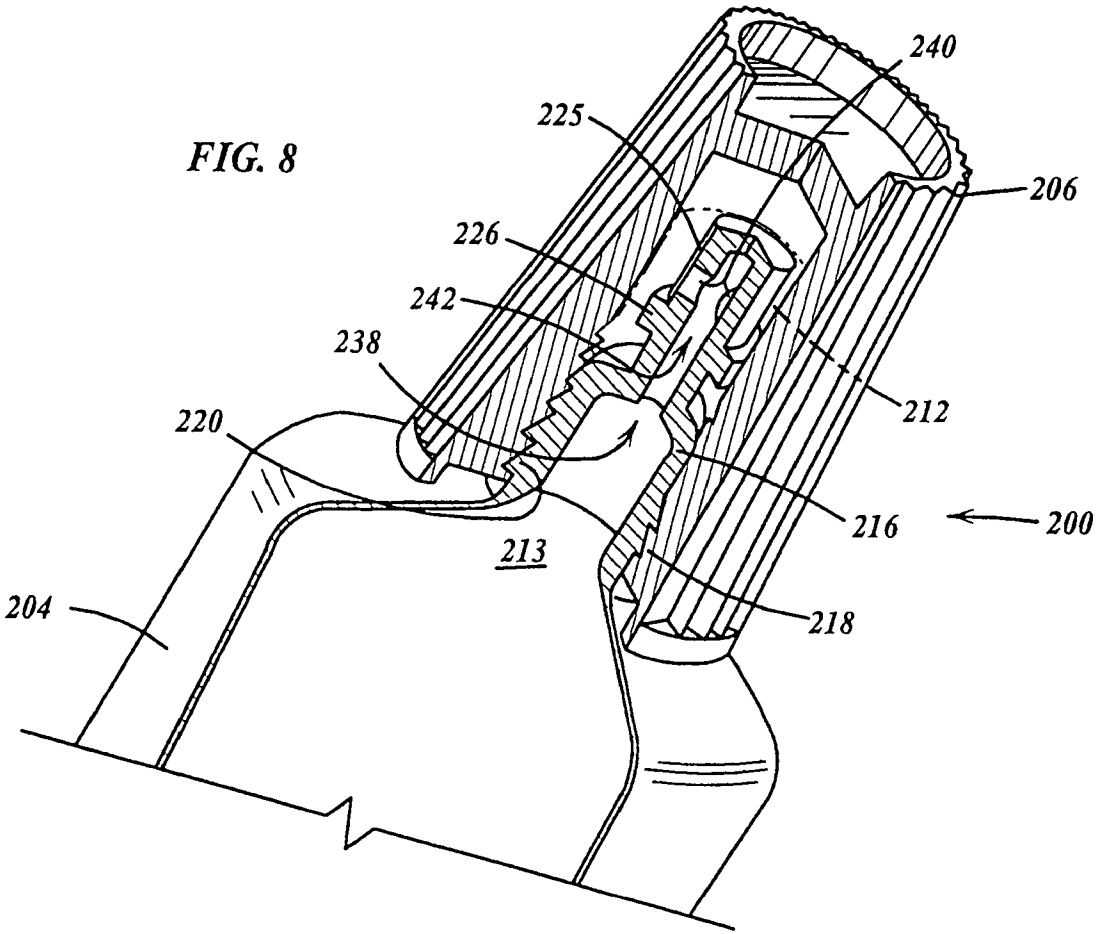
FIG. 8 illustrates an enlarged, partially broken away perspective view of the nozzle of the container of FIG. 5.
Figure 8B:
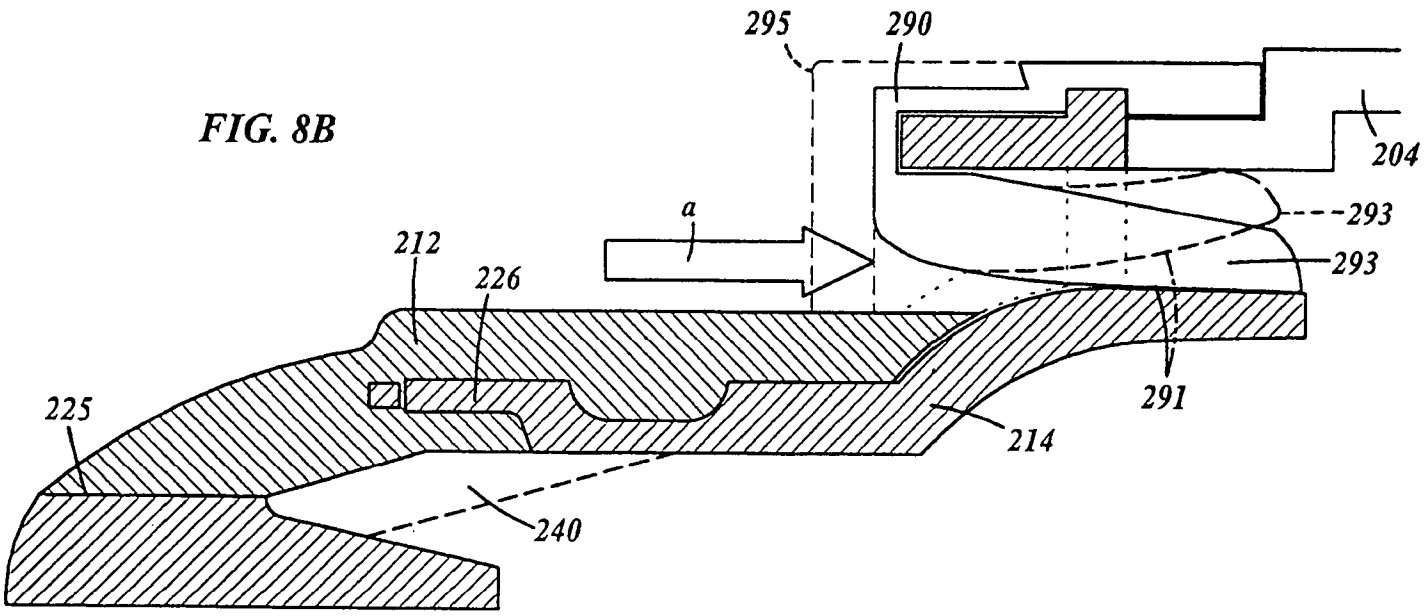
FIG. 8B illustrates a partial, cross-sectional view of another nozzle with a flexible shoulder for a container for storing and releasing a substance from a sterile environment.
Figure 9:
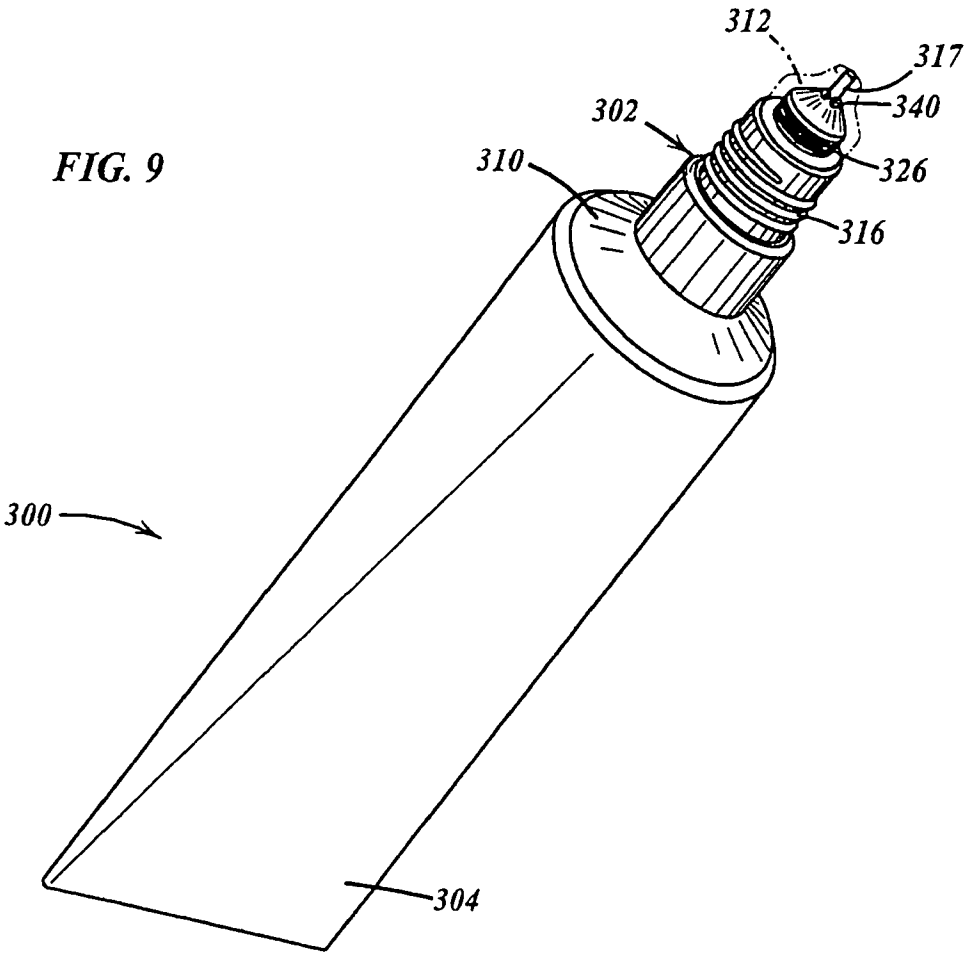
FIG. 9 illustrates a perspective view of still another container for storing and releasing a substance from a sterile environment.
Figure 10:
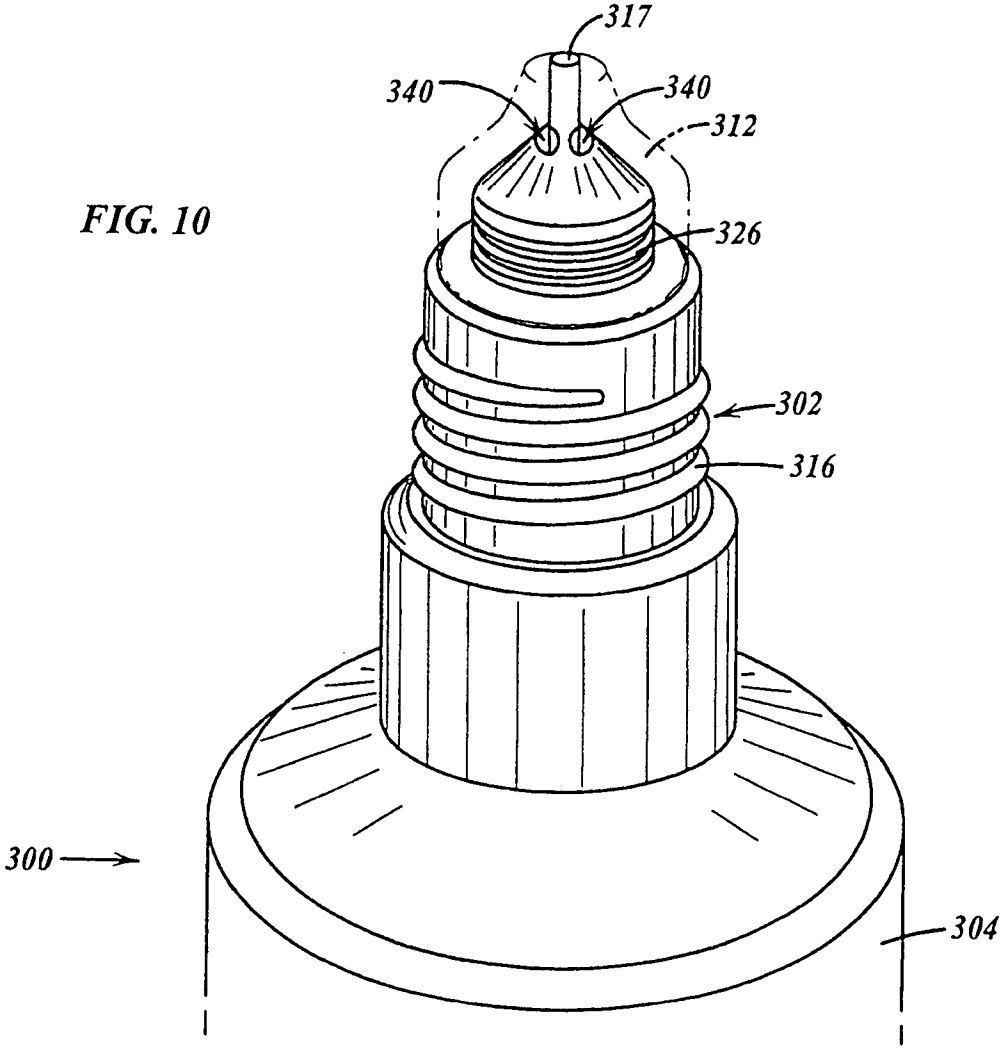
FIG. 10 illustrates a partial, perspective view of the container of FIG. 9.
Figure 11:
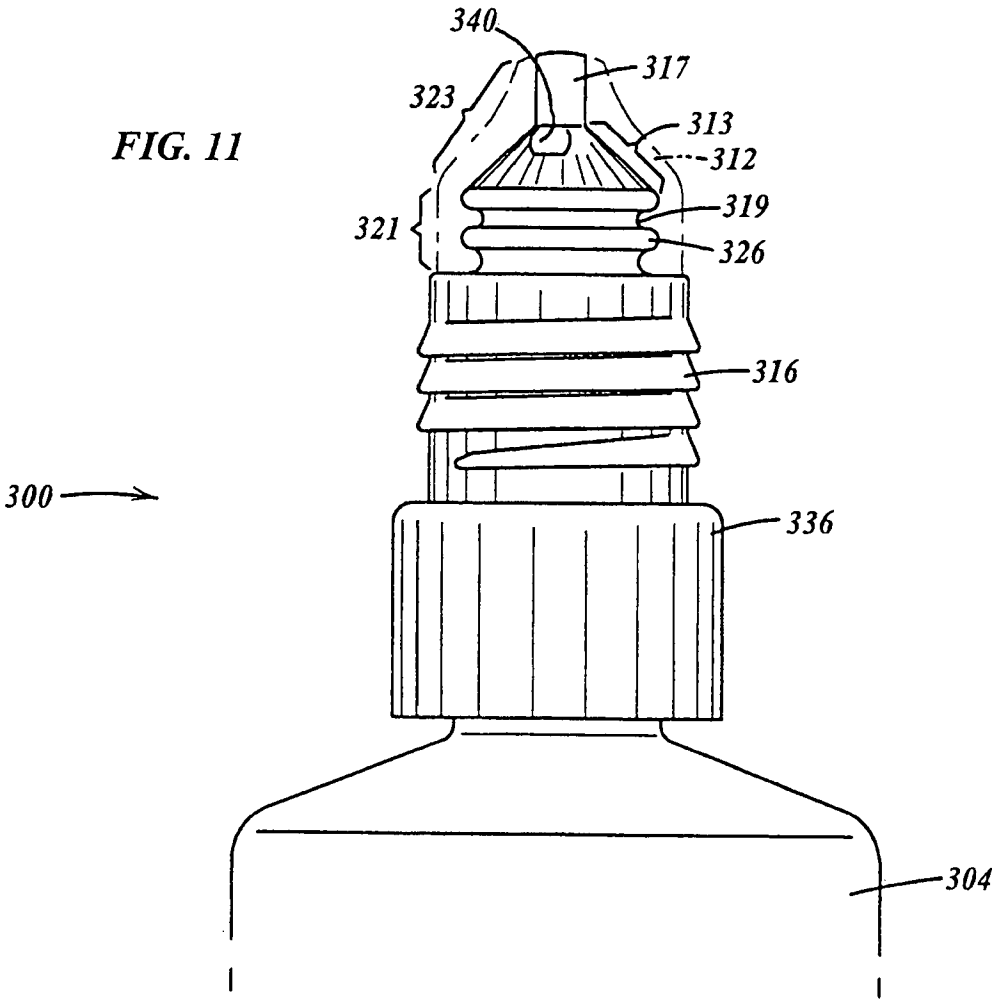
FIG. 11 illustrates a partial, side elevational view of the container of FIG. 9.

In another embodiment, shown in FIG. 8B, a container has a flexible shoulder 290 sealing the interior of the tubular body 204 from the ambient atmosphere. As can be seen, the distal end of the body 204 is spaced radially outwardly relative to the base of the inner body 214 to define a normally-closed fill opening 291 therebetween. The flexible shoulder 290 defines an annular sealing member 293 that extends axially inwardly into the space formed between the base of the inner body 214 and tubular body 204. The flexible shoulder 290 is preferably formed of an elastomeric material that normally engages the adjacent base of the inner body 214 and forms a fluid-tight or hermetic seal therebetween. During filling, a filling member (not shown) is moved either adjacent to, or into the aperture 291, and the product is pumped therethrough, as indicated by the arrow "a". As a result, either the filling member (not shown) or the flow of product in the direction of the arrow "a" causes the sealing member 293 to flex radially away from the inner body base 214 and open the flow aperture 291 to allow the product to flow therethrough and into the interior of the container. After filling, the sealing member 293 returns to the normally closed position to hermetically seal the flow opening 291 and thereby seal the product within the container. As can be seen, because the distal or inner end of the sealing member 293 is directed radially inwardly relative to its base, the sealing member will not open in response to the pressure created upon dispensing the product through the nozzle, but rather will maintain the hermetic seal throughout the shelf life and usage of the container. As indicated in broken lines in FIG. 8B, a cap or other closure 295 may be secured to the shoulder 290 after filling to prevent any unwanted substances from being inadvertently or otherwise introduced through the flow opening 291 and into the interior of the container. The closure 295 may take any of numerous different configurations that are currently or later become known for performing this function, and the closure is preferably tamper proof such that if anyone does tamper with the sealed closure the tampering will be evident and the container may be discarded. As may be recognized by those of ordinary skill in the pertinent art based on the teachings herein, there are a variety of useful apparatus and methods for filling that are currently and may later become known to those of ordinary skill in the pertinent art, and such apparatus and methods equally may be used to fill the different embodiments of the present disclosure.

Turning to FIGS. 9-12, another embodiment is indicated generally by the reference numeral 300. The container 300 is similar to the containers 100 and 200 described above, and therefore like reference numerals preceded by the numeral "3" instead of the numerals "1" and "2", are used to indicate like elements whenever possible. The primary difference of the container 300 in comparison to the containers 100, 200 is that the nozzle 302 is a different configuration.

As with the nozzles described above, the nozzle 302 may be composed of any suitably durable, moldable, somewhat flexible material, such as a plastic material, and preferably is composed of a material which has been found to be compatible with the particular product contained therein, such as those materials sold under the trademarks VELEX® and LEXAN®, both owned by the General Electric Company of Fairfield, Conn., or under the trademark KRATON® owned by Kraton Polymers U.S. LLC. The inner body 314 of the nozzle 302 is preferably molded of one piece and comprises a truncated, conical-shaped or frusto-conical shaped body portion 313 (FIG. 12) terminating in a post or valve seat 317 on one end and a shoulder or cylindrical wall 336 on the other end. Preferably, the body portion 313 is oriented at an angle of about 45 degrees or less with respect to the axis of the container 300 to minimize the head loss of the product when dispensed. In a preferred embodiment, the angle of the body portion 313 is about 30 degrees. The shoulder 336 defines an axial flow path 348 which is greater in diameter than the post 317. In another embodiment (not shown), the diameter of the post 317 is larger than that of the axial flow path 348 to increase the size of the flow opening and correspondingly reduce the required valve opening pressure. As may be recognized by those of ordinary skill in the pertinent art based on the teachings herein, the diameter (or radial or lateral dimension) of the valve seat of the nozzle disclosed herein can be adjusted, along with one or more of the degree of interference between the valve cover and the valve seat, the radial thickness of the valve portion of the valve cover, and the modulus of elasticity of the valve cover material, to achieve a desired valve opening pressure. As further described herein, one or more of these variables also can be selected to ensure that the valve assembly hermetically seals the interior of the container and prevents the ingress or bacteria or other unwanted substances through the valve and into the tube.

Figure 12:
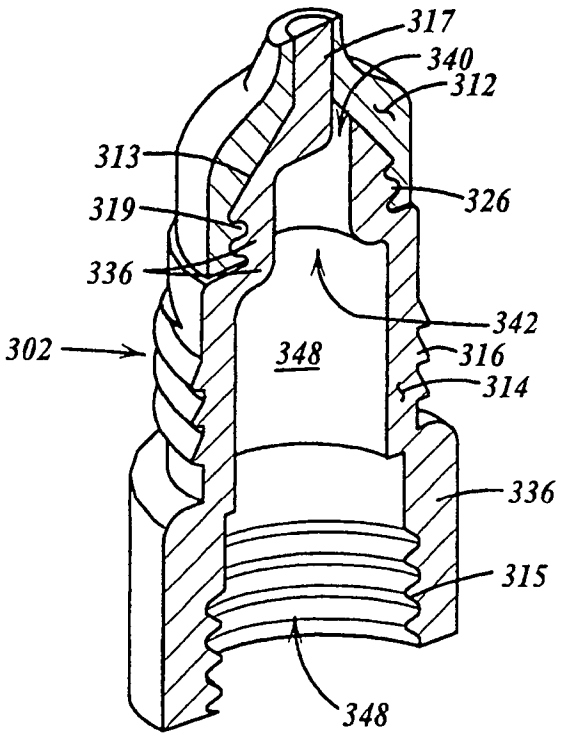
FIG. 12 illustrates an enlarged, partially broken away view of the nozzle of the container of FIG. 9.
Figure 12A:
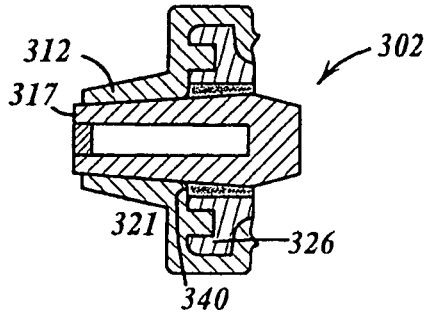
FIG. 12A illustrates a cross-sectional, somewhat schematic view of a nozzle similar to the nozzle of the container of FIG. 9 where the nozzle is at rest.
Figure 12B:
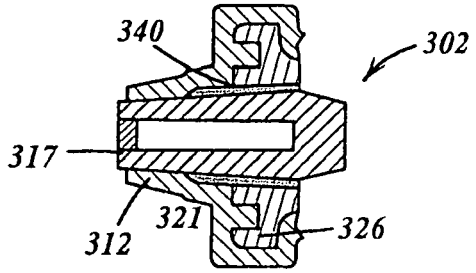
FIG. 12B illustrates a cross-sectional, somewhat schematic view of a nozzle similar to the nozzle of the container of FIG. 9 where the nozzle is beginning to have pressure.
Figure 12C:
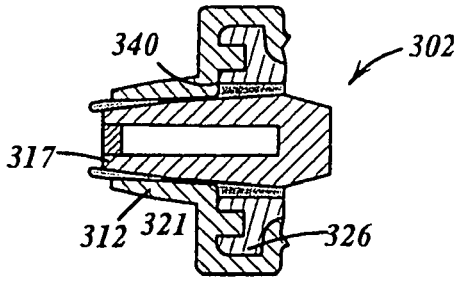
FIG. 12C illustrates a cross-sectional, somewhat schematic view of a nozzle similar to the nozzle of the container of FIG. 9 where the nozzle is releasing the substance.

Referring to FIGS. 12A-C, preferably, and as indicated above, the axial extent of the valve seat or post 317 (i.e., the sealing surface between the valve seat and valve cover) is sufficiently long so that at any time during dispensing, a respective portion of the valve cover engages the valve seat to thereby prevent fluid communication between the product retained within the container and the ambient atmosphere. The post 317 has three regions labeled 1, 2 and 3. The first region 1 is the area in which the valve cover 312 blocks the flow aperture 340. The third region 3 is the area from which the substance exits the container 300. The second region 2 is the area intermediate the first region 1 and the third region 3. Each region 1, 2, 3 has an associated pressure P1, P2 and P3, respectively. At rest, each pressure P1, P2, P3 is equal to zero. As the container 300 is squeezed, and as shown in FIG. 12B, pressure builds in the first region 1 until a portion of the valve cover 312 unseats from the post 317. The substance flows into the second region 2 creating rising pressure in the second region 2 and third region 3 where P1>P2>P3. As shown in FIG. 12C, the substance travels into the third region 3 but prior to exiting the container 300, the valve cover 312 reseats on the post 317 in the first region 1 to retain the hermetic seal and prevent any opportunity for contamination to enter the container 300. As the substance is released, the relative pressure relationship is as follows P1<P2>P3>0.

As with the other embodiments of the valve assembly disclosed herein, the valve cover 312 preferably defines a cross-sectional (or radial) thickness that is progressively reduced moving axially in the direction from the interior to the exterior of the valve assembly. Thus, as shown typically in FIGS. 12A-12C, the valve cover defines a tapered cross-sectional profile that tapers inwardly when moving axially in the direction from the interior toward the exterior of the valve. In addition, as described further below, the interface between the valve cover and valve seat may define a decreasing level of radial interference when moving axially in the direction from the interior toward the exterior of the valve assembly, i.e., the valve cover may define a greater degree of radial interference with the valve seat in region 1 than in region 2, and may define a greater degree of radial interference in region 2 than in region 3 at the tip of the nozzle. Accordingly, the energy required to open the respective segments of the valve cover progressively decreases when moving axially in the direction from the interior toward the exterior of the valve. As a result, once the base region 1 of the valve is opened and the substance enters the normally closed seam or valve opening, the resilient nature of the valve cover, and construction of the valve assembly as described above, causes the valve cover to progressively return itself to the normally closed position and, in turn, force the dosage of substance axially through the seam. Further, the valve cover forces the substance within the seam out through the tip of the nozzle, and thus prevents substance from collecting within the valve and creating residual seepage at a later point in time.

As shown best in FIG. 12, a flange 326 is disposed coaxially with the conical-shaped portion 313 and extends radially therefrom. In a preferred embodiment, the conical-shaped portion 313 is frusto-conical-shaped. The flange 326 helps retain the outer body 312 and creates a constrained surface overlying the flow aperture 340 to, in turn, reduce and otherwise prevent the residual seepage of material. An annular recess 319 is formed between the conical-shaped portion 313 and the flange 326. It will be recognized that the conical-shaped portion 313 and flange 326 may be molded together or separately. Similarly, the inner body 314 and tube 304 may be integral or distinct components. The conical-shaped portion 313 comprises a central bore 342 in communication with the interior of the tube 304 by axial flow path 348. The central bore 342 terminates in a plurality of release apertures 340 through which the product may flow axially. Container 300 includes three release apertures 340 approximately equally spaced relative to each other about the axis of the nozzle 302 such that, in cross-section, the area defined by the release apertures 340 is greater than the remaining solid portions. However, as may be recognized by those of ordinary skill in the pertinent art based on the teachings herein, the nozzle 302 may include any desired number of such release apertures in any desired configuration depending upon the application of the dispenser or otherwise as required. In one preferred embodiment, the configuration of release apertures are at least about 50% of the annular area, and most preferably between about 70% and about 90%.

The outer body cover 312 may be composed of any durable, resilient and flexible material having the desired modulus of elasticity, such as an elastomeric material. Preferably, the outer body cover 312 is composed of a thermoelastic material, such as a styrene-butadiene elastomer sold under the trademark KRATON®. Other suitable materials include without limitation polyvinylchloride, APEX FLEX-ALLOY™ material available from Teknor Apex Company, SANTOPRENE® rubber available from Advanced Elastomer Systems and butyl rubber. In a preferred embodiment, the inner body 314 is fabricated from KRATON® material which has a modulus of elasticity of approximately 4.1 Mpa and the outer cover 312 is fabricated from SANTOPRENE® material which has a modulus of elasticity of approximately 2.6 Mpa to approximately 4.1 Mpa. The outer body cover 312 comprises a mounting portion 321 and a tapered portion 323 which cooperate with the inner body 314 to provide a hermetic one-valve. The mounting portion 321 defines an annular recess that engages the conical-shaped portion 313 and the flange 326 to couple the outer body cover 312 thereto. Because of the resilient nature of the material of the outer body cover 312, the inner body 314 may be slightly oversized in order to provide a resilient interference fit. In one embodiment, the outer body cover 312 is molded to the same dimension as the inner body 314 and post-molding shrinkage of the outer body cover 312 results in the desired interference fit.

The outer body or valve cover 312, when mounted, is dimensioned and configured to resiliently engage the inner body 314 whereby the tapered portion 323 and post or valve seat 317 form a normally-closed, one-way valve therebetween. As described above and shown typically in FIG. 12, the cross-sectional thickness of the tapered portion 323 gradually decreases in the axial direction toward the distal end or tip of the nozzle. As a result, the pressure required to open the valve seat gradually decreases to facilitate the release of the product through the one-way valve, while simultaneously preventing air or other gases from passing through the one-way valve in the opposite direction. Preferably, a substantially annular segment of the outer body cover 312 engages the post 317 throughout any period of dispensing to maintain a hermetic seal between the interior and ambient atmosphere as shown in FIGS. 12A-C. If desired, and as also described above, the degree of interference between the tapered portion 323 of the valve cover and the valve seat 217 may progressively decrease in a direction from the interior to the exterior of the nozzle 302 by varying the inner diameter of the outer body cover 312 and/or the size of the inner body 314. Preferably, a cap (not shown) couples to the threads 316 of the inner body 314 to seal the nozzle 302 and prevent inadvertent discharge of the product.

Figure 13:
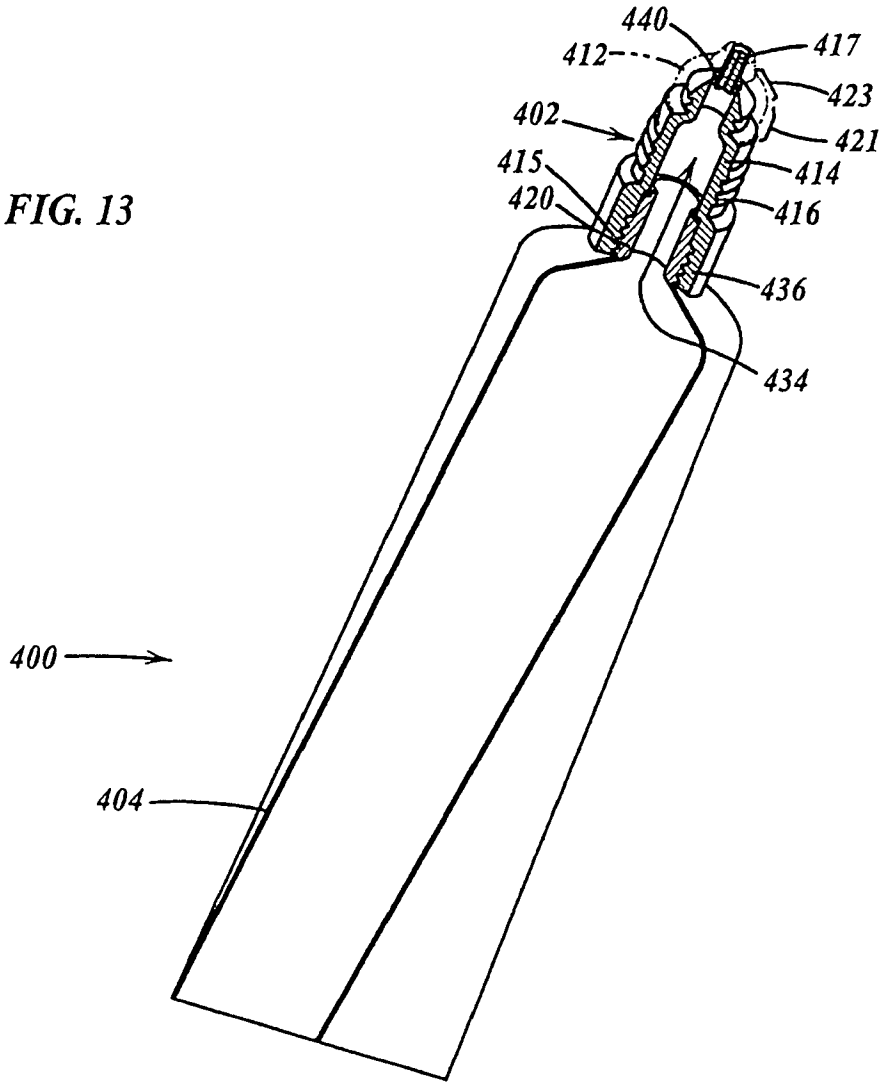
FIG. 13 illustrates a partially broken away, perspective view of the nozzle of the container of FIG. 9.
Figure 14:
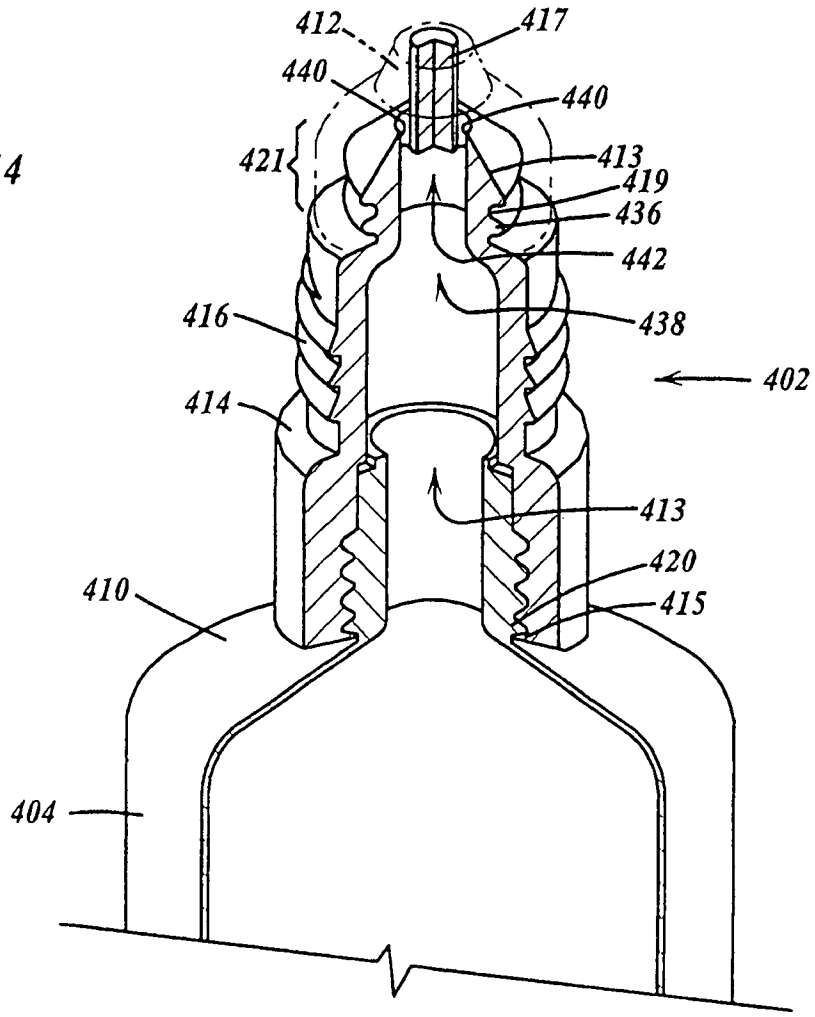
FIG. 14 illustrates a partial, enlarged, partially broken away perspective view of the nozzle of the container of FIG. 9.
Figure 15:
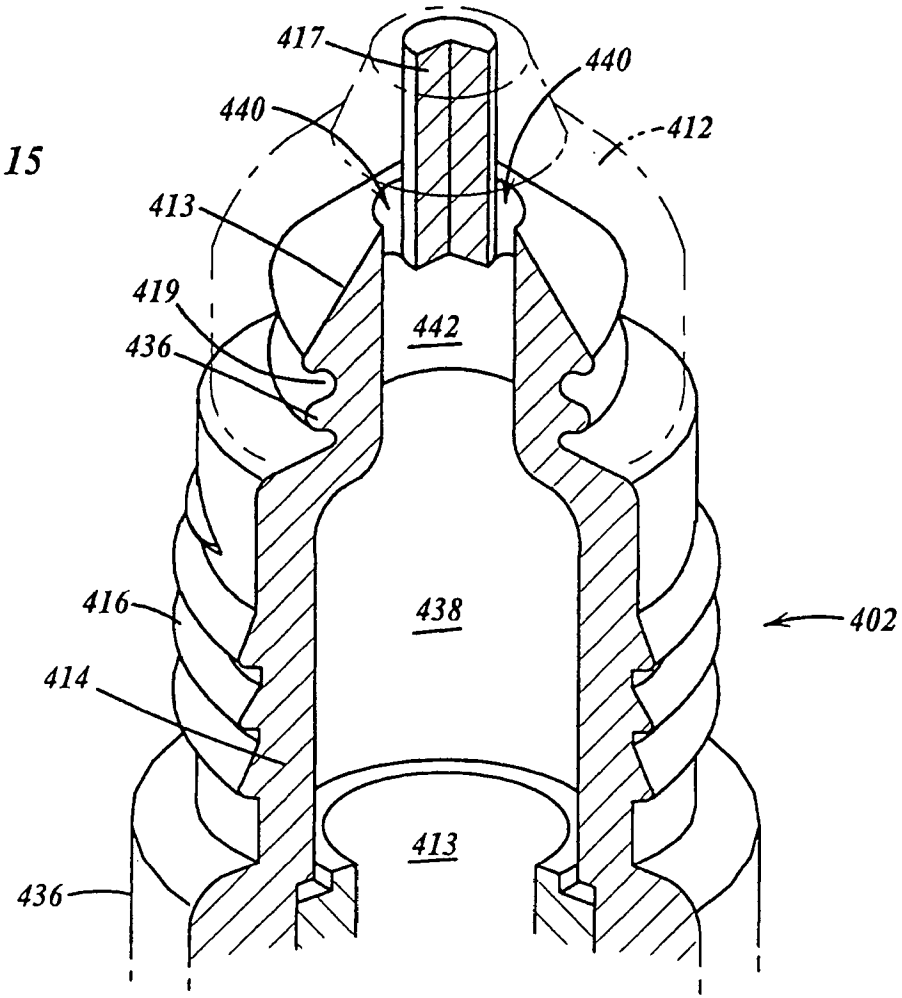
FIG. 15 illustrates another partial, enlarged, partially broken away perspective view of the nozzle of the container of FIG. 9.

Referring now to FIGS. 13-15, the nozzle 402 is similar to the nozzles described above, and therefore like reference numerals preceded by the numeral "4" instead of the numerals "1", "2" and "3", are used to indicate like elements whenever possible. One advantage of the configuration illustrated in embodiments 300 and 400 is that the product follows a substantially straight flow path extending in a direction parallel to the axis of the container 300, 400. This relatively straight and smooth flow path allows the product to flow through the nozzles 302, 402 with relatively little head loss, thus allowing lesser force to dispense the product and preventing spaces where the product may undesirably collect.

In addition, it maybe desirable to make the outer diameter of the valve seat 317 as large as possible to thereby decrease the requisite valve opening pressure that must be generated upon the squeeze tube 404 in order to open the valve and dispense product through the valve. The present inventor has recognized that a variety of factors can affect the valve opening pressure, including the diameter of the valve seat 417, the modulus of elasticity of the valve cover 412, the degree of interference between the valve cover 412 and valve seat 417, and the thickness and shape of the valve seat 417. All other factors being equal, the volumetric flow rate of material through the valve will be greater for increasing diameters of the valve seat 417 and the requisite valve opening pressure will decrease. The present inventor has recognized that it may be desirable to (1) increase the diameter of the valve seat 417 in comparison to prior art valves in order to decrease the requisite valve opening pressure that must be created upon squeezing the tube; (2) decrease the head loss of the product flowing through the valve in comparison to prior art valves; and (3) decrease the stored elastic energy in the valve upon dispensing the product through the valve in order to, in turn, decrease the residual seepage of product through the valve. A significant advantage of the valves illustrated in FIGS. 9-15 and in the additional embodiments described herein is that the flow openings 440 define flow paths substantially parallel to the axes of the containers to, in turn, minimize the head loss of products flowing through the valves.

As a result, it will be appreciated by one of ordinary skill in the art based upon review of the subject disclosure that at least one of the valve seat diameter, a degree of interference between the valve cover 312 and valve seat 317, the predetermined radial thickness of the valve portion 323 of the valve cover 317, and a predetermined modulus of elasticity of the valve cover 312 material, can be selected to (1) define a predetermined valve opening pressure generated upon manually squeezing the tube 304 that allows passage of the substance from the storage chamber through the valve opening 340, and (2) hermetically seal the valve 302 and prevent the ingress of bacteria or other unwanted substances or impurities through the valve 302 and into the tube 304 in the normally closed position.

Figure 15A:
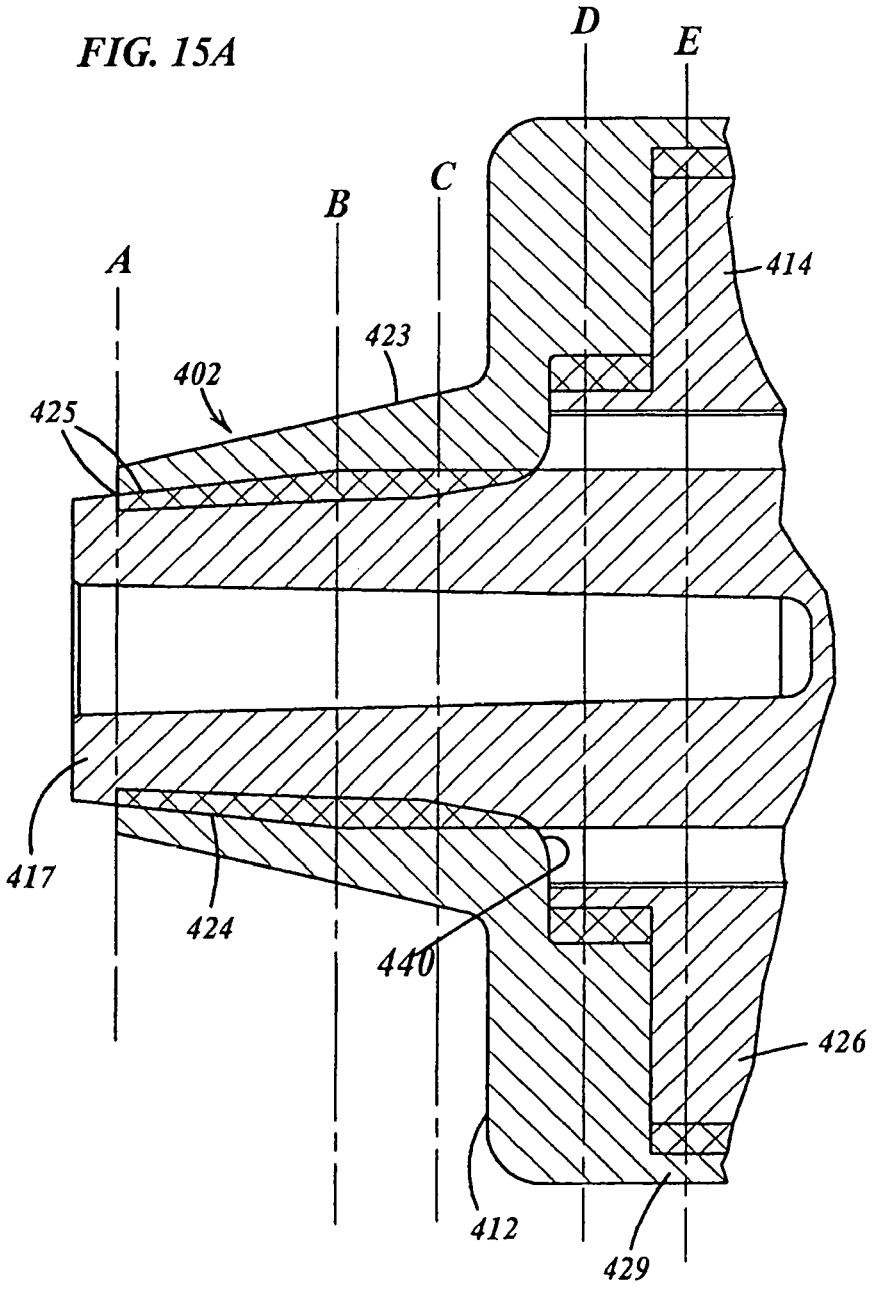
FIG. 15A illustrates a partial, cross-sectional view of the tip of the nozzle of the container of FIG. 9.
Figure 15B:
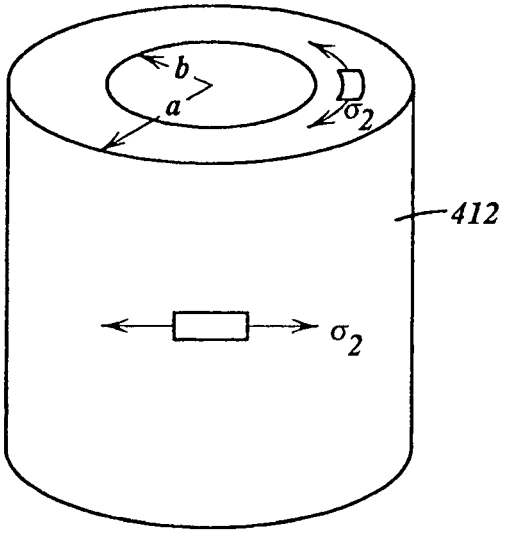
FIG. 15B illustrates a schematic perspective view of a portion of a valve cover for the nozzle of the container of FIG. 9.

In another embodiment shown in FIG. 15A, the valve seat 417 extends through the nozzle 402 into the interior of the tube. The valve body 414 defines a plurality of flow apertures 440 that extend angularly about the valve seat 424, and are angularly spaced relative to each other with corresponding solid portions formed therebetween. In a currently preferred embodiment, the valve body defines three angularly extending flow apertures 440. As indicated above, the flow apertures 440 preferably extend through at least about 50% of the annulus on which they lie, and most preferably extend through between about 70% and about 90% of the annulus on which they lie. As also shown typically in FIG. 15A, the degree of interference between the valve cover 412 and valve seat 424 is illustrated visually by the overlap in the cross-hatched lines. As can be seen, there is a significant degree of interference between the valve cover and the valve seat in order to ensure the formation of the desired hermetic seal in the normally closed position. In the embodiment of FIG. 15A, the valve seat 424 defines a tapered distal portion, and the valve portion 423 of the valve cover defines a tapered cross-sectional profile as described above. As may be recognized by those of ordinary skill in the pertinent art based on the teachings herein, the valve seat may take any of numerous different configurations, include a straight profile or consistent diameter from one end to the other, or a tapered or other varying configuration, in order to achieve certain performance criteria or other desired objectives.

Depending upon the viscosity of the product, the configuration of the nozzle 402 can be varied to achieve a desired valve opening pressure and to ensure the consistent formation of a hermetic seal in the normally closed position. For example, the outer cover 412 can have varying levels of interference and modulus of elasticity which contribute to the valve opening pressure, i.e. the stress required in the circumferential direction to open the valve. With reference to FIG.

15B, which illustrates schematically an axial segment of the valve cover 412, the formulas for determining the valve opening pressure are as follows:

$$\Delta a = \frac{q}{E} - \frac{2ab^2}{a^2 - b^2}$$

$$\Delta b = \frac{qb}{E}\frac{a^2 + b^2}{a^2 - b^2} + v$$

$$\sigma_2 = \frac{qb^2(a^2 + r^2)}{r^2(a^2 - b^2)}$$

$$\max\sigma_2 = q\frac{(a^2 + b^2)}{(a^2 - b^2)} \text{ when } r = b$$

solving for q yields $$q = \Delta b E b \frac{a^2 + b^2}{a^2 - b^2} + v$$

insert q in above yields $$\max\sigma_2 = \frac{\Delta b E(a^2 + b^2)}{b\frac{a^2 + b^2}{a^2 - b^2} + v}(a^2 - b^2)$$

wherein q=unit pressure (force per unit area); a=outer radius; b=inner radius; $\sigma_2$=stress in circumferential direction; E=modulus of elasticity; v=Poisson's ratio (approximately 0.4); Δa=change in radius a; and Δb=change in radius b. By applying these formulas to the five locations A, B, C, D, E of FIG. 15A, the different parameters can be calculated. Based upon these formulas, Table 1 provides exemplary data for the embodiment of FIG. 15A at five locations A-E illustrated in FIG. 15A.

TABLE 1

| | | | | |
|---|---|---|---|---|
| A (Groove Section) | | | | |
| | E = | 4.137931034 | Mpa | |
| Poisson's Ratio | (v) = | 0.4 | | |
| Outer | Radius a = | 1.62 | mm | |
| Inner | Radius b = | 1.28 | mm | |
| | Delta a = | 0.084596753 | mm | |
| | Delta b = | 0.095 | mm | |
| Internal Pressure | q = | 0.065020291 | Mpa | 9.43690728 psi |
| Stress | σ = | 0.281103953 | Mpa | 40.798832 psi |
| B (Groove Section) | | | | |
| | E = | 4.137931034 | Mpa | |
| Poisson's Ratio | (v) = | 0.4 | | |
| Outer | Radius a = | 2.08 | mm | |
| Inner | Radius b = | 1.39 | mm | |
| | Delta a = | 0.184300368 | mm | |
| | Delta b = | 0.23 | mm | |
| Internal Pressure | q = | 0.227177379 | Mpa | 32.97204338 psi |
| Stress | σ = | 0.593822673 | Mpa | 86.18616442 psi |
| C (Groove Section) | | | | |
| | E = | 4.137931034 | Mpa | |
| Poisson's Ratio | (v) = | 0.4 | | |
| Outer | Radius a = | 2.295 | mm | |
| Inner | Radius b = | 1.4 | mm | |
| | Delta a = | 0.165350559 | mm | |
| | Delta b = | 0.22 | mm | |
| Internal Pressure | q = | 0.251511379 | Mpa | 36.50382854 psi |
| Stress | σ = | 0.549641754 | Mpa | 79.77383947 psi |

TABLE 1-continued

| | | | | |
|---|---|---|---|---|
| D (Groove Section) | | | | |
| | E = | 4.137931034 | Mpa | |
| Poisson's Ratio | (v) = | 0.4 | | |
| Outer | Radius a = | 4.75 | mm | |
| Inner | Radius b = | 2.3 | mm | |
| | Delta a = | 0.197999223 | mm | |
| | Delta b = | 0.315 | mm | |
| Internal Pressure | q = | 0.281593521 | Mpa | 40.86988699 psi |
| Stress | σ = | 0.454079233 | Mpa | 65.9040977 psi |
| E (Groove Section) | | | | |
| | E = | 4.137931034 | Mpa | |
| Poisson's Ratio | (v) = | 0.4 | | |
| Outer | Radius a = | 4.75 | mm | |
| Inner | Radius b = | 4.25 | mm | |
| | Delta a = | 0.237919859 | mm | |
| | Delta b = | 0.25 | mm | |
| Internal Pressure | q = | 0.025818142 | Mpa | 3.747190459 psi |
| Stress | σ = | 0.233080451 | Mpa | 33.82880276 psi |

Figure 15C:
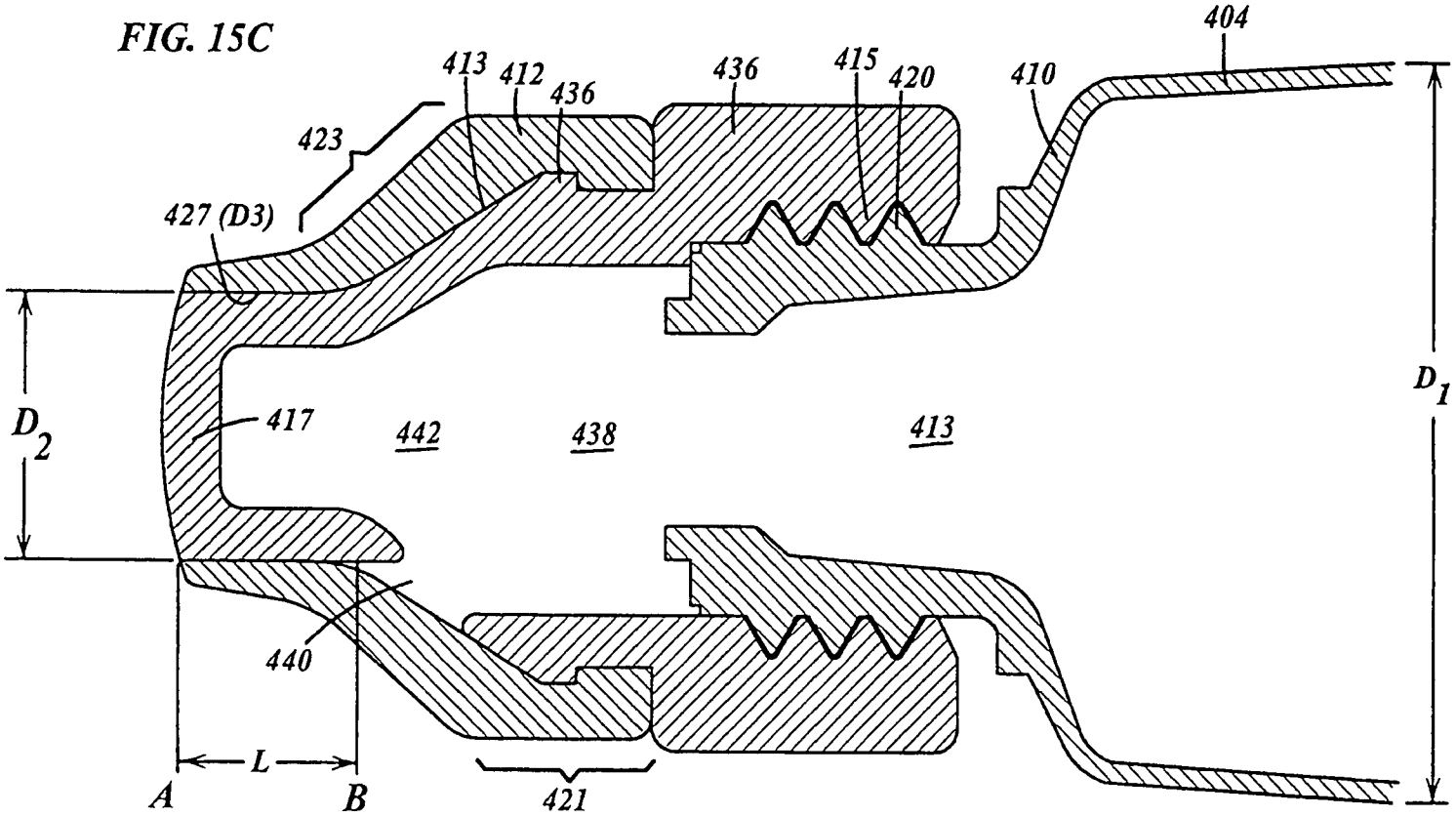
FIG. 15C illustrates another cross-sectional view of the nozzle of the container of FIG. 9.
Figure 15D:
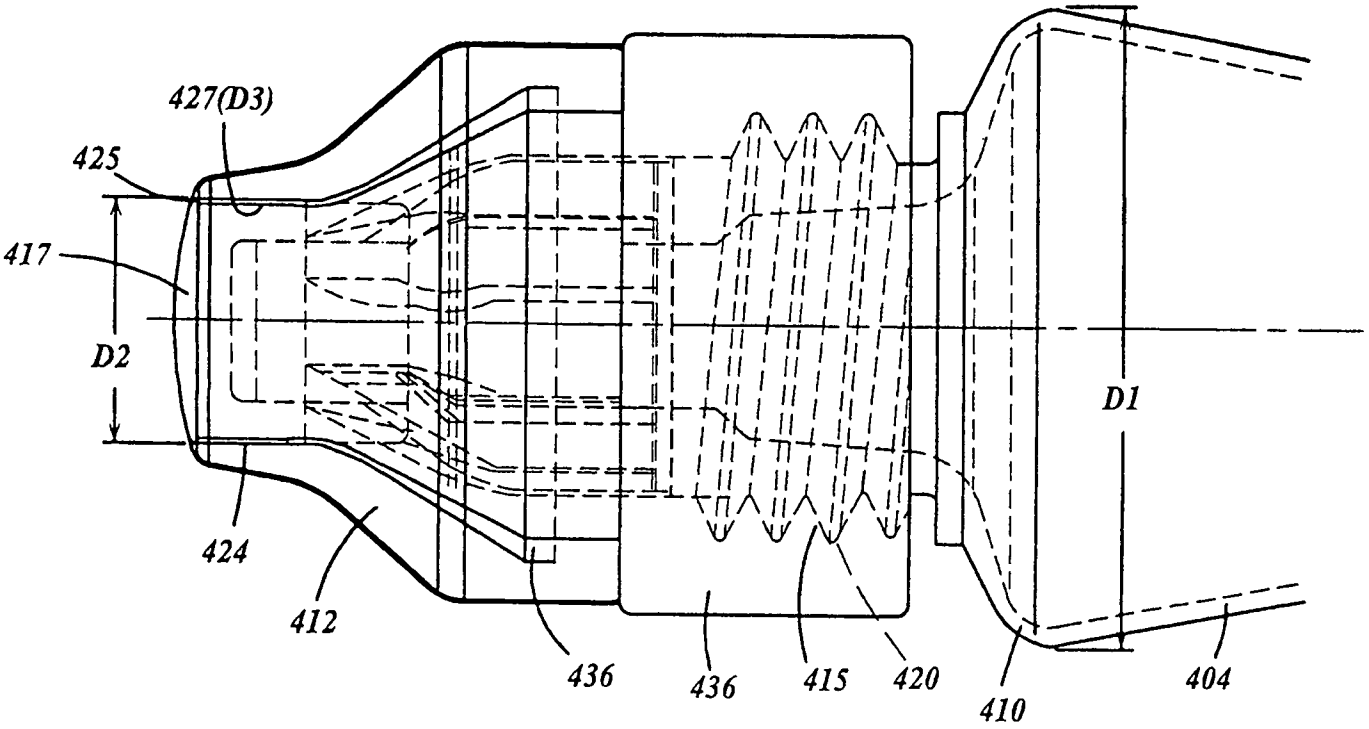

In FIGS. 15C and 15D, the tube 404 defines a maximum diameter D1, the valve seat 424 defines a constant diameter D2, and the axial length of the valve seat (or the sealing surface of the valve seat) is defined as "L" and extends between point "A" at the tip of the nozzle, and point "B" adjacent to the radially inner edges of the flow apertures 440. The valve portion 423 defines an inner annular surface 427 that extends axially in engagement with the valve seat 424 and cooperates with the valve seat to define the length "L" of the sealing surface. The relaxed or unstretched diameter of the annular surface 427 of the valve portion is defined as D3. As described above, the inner diameter D3 of the annular surface 427 is less than the outer diameter D2 of the valve seat 424 in order to form an interference fit and thus a hermetic seal therebetween. In FIG. 15D, the line drawing shows the valve cover lines in both the stretched and unstretched states to illustrate visually the interference between the valve cover and inner body. In the illustrated embodiment, the degree of interference between the valve seat and valve cover is substantially constant along the length "L" of the sealing surface. However, as indicated above, the degree of interference may be varied, if desired. Exemplary values for the parameters for currently preferred embodiments are illustrated in Table 2 below. The interference between the valve seat outer diameter D2 and the valve cover inner diameter D3 is labeled "I" and is determined based on the differences in the two diameters divided by two. The thickness of the valve cover at point A is labeled "T1(A)" and the thickness of the valve cover at point B is labeled "T2(B)".

TABLE 2

| D1 | D2 | D3 | I | L | T1(A) | T2(B) |
|---|---|---|---|---|---|---|
| 1 inch | 7.6 mm | 6.8 mm | 0.4 mm | 3.28 mm | 0.71 mm | 1.25 mm |
| 0.5 inch | 5.0 mm | 4.6 mm | 0.2 mm | 3.9 mm | 0.5 mm | 0.8 mm |

In one embodiment, wherein the valve seat diameter D2 is 5 mm, the valve opening pressure corresponds to a force that is substantially radially directed onto a mid-portion of the tubular body within the range of about 2.4 kg and about 2.9 kg. In another embodiment of the present disclosure, wherein the valve seat diameter D2 is 10 mm, the valve opening pressure corresponds to a force of about 5.4 kg that is substantially radially directed onto a mid-portion of the tubular body. Preferably, the valve opening pressure corresponds to a substantially radially directed force applied to a mid-portion of the tubular body within the range of about 1 kg through about 6 kg, and more preferably within the range of about 2 kg through about 4 kg, and most preferably within the range of about 2.4 kg through about 2.9 kg. The length "L" of the valve seat (or sealing surface thereof), is preferably at least about 30% of the diameter D2 of the valve seat, and is preferably within the range of about 40% to about 85% of the diameter D2 of the valve seat. For smaller diameter tubes, the valve seat necessarily may define a smaller diameter D2, and therefore the ratio of the length "L" of the valve seat to the diameter D2 typically will be greater the smaller the tube. Thus, for approximately 1 inch diameter tubes as described above, the length "L" of the valve seat is preferably within the range of about 25% to about 75% of the valve seat diameter D2, and most preferably is within the range of about 35% to about 65% of the valve seat diameter D2. For approximately 0.5 inch diameter tubes as described above, on the other hand, the length "L" of the valve seat is preferably at least about 60% of the diameter D2, is more preferably at least about 75% of the diameter D2, and is most preferably greater than 75% of the diameter D2.

It is envisioned that the containers disclosed herein may receive liquids, suspensions, gels, creams, pasty products, fluids, and the like which typically are at risk for growing germs or in the past have required preservatives. For example, the container may store vacuum packed, UHT milk alleviating the need for refrigeration, baby formula, toothpaste, premeasured dosages of baby food in accordance with the principles disclosed in U.S. patent application Ser. No. 10/272,577 filed Oct. 16, 2003 (incorporated herein by reference in its entirety), as well as petrogels, beverages carbonated and otherwise, yoghurt, honey, ketchup, mustard, mayonnaise and tartar sauce in single or multiple servings.

Figures 16, 17:
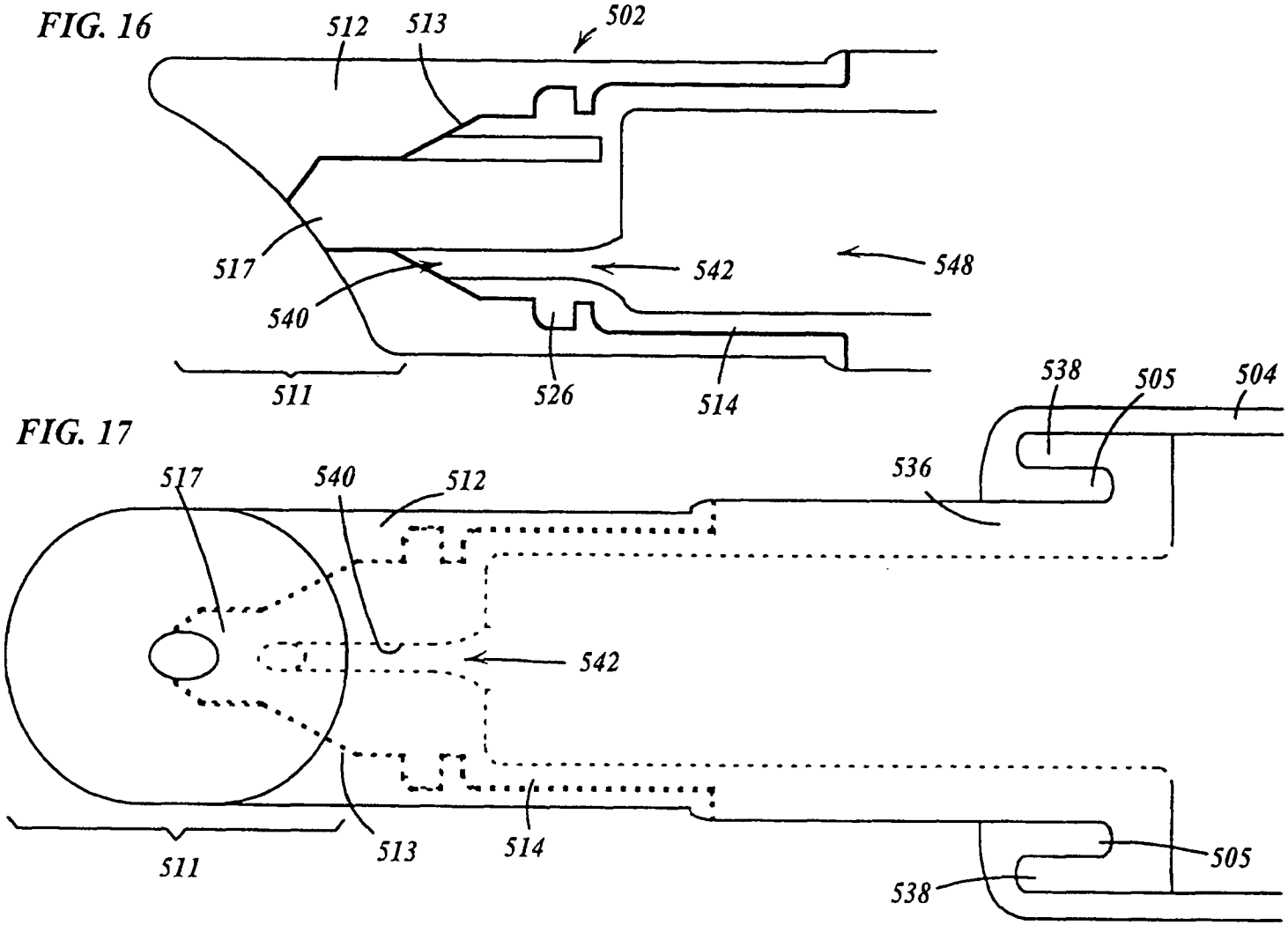
FIG. 16 illustrates a cross-sectional view of another nozzle for a container for storing and releasing a substance from a sterile environment.
FIG. 17 illustrates a line drawing of the nozzle of FIG. 16.

In FIGS. 16 and 17, another container embodiment is indicated generally by the reference numeral 500. The container 500 is substantially the same as the containers described above in connection with FIGS. 1-14, and therefore like reference numerals preceded by the numeral "5" instead of the numerals "1" through "4", are used to indicate like elements whenever possible. As can be seen, the container 500 includes a dispensing tip 511 shaped to conformably contact a user's lips by defining, for example, a substantially concave surface contour. It will be appreciated by those of ordinary skill in the pertinent art that a different contour for conformably and/or comfortably contacting a user's skin or lips may be utilized. The inner body 514 of the nozzle 502 is preferably molded of one piece and terminates in a post or valve seat 517 on one end and a shoulder 536 on the other end. The shoulder 536 has a projection 538 for sealingly engaging a projection 505 of the flexible tube 504 to, in turn, secure the nozzle 502 to the tube 504. Preferably, the inner body is fabricated from KRATON® material exhibiting a hardness of about 65 shore A, and the valve cover 512 is fabricated from KRATON® material exhibiting a hardness of about 20 shore A. However, as may be recognized by those of ordinary skill in the pertinent art, these hardnesses are only exemplary, and may be changed as desired to meet certain performance criteria or otherwise as desired.

Figure 18:
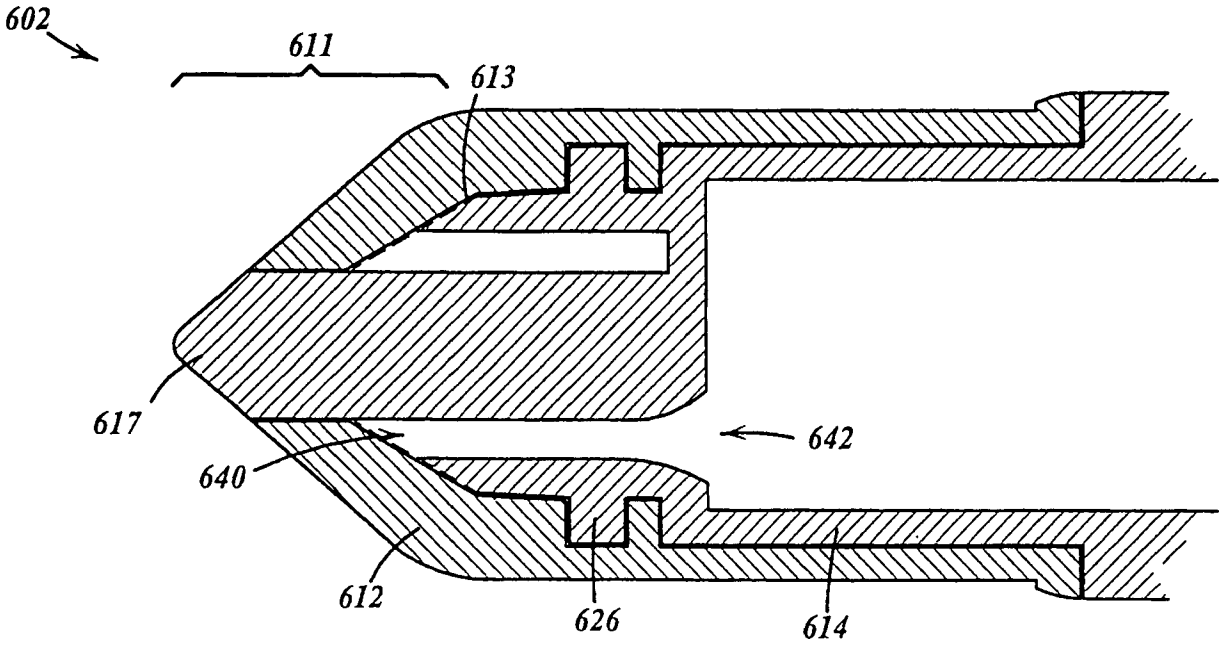
FIG. 18 illustrates a cross-sectional view of still another nozzle for a container for storing and releasing a substance from a sterile environment.

In FIG. 18, another container embodiment is indicated generally by the reference numeral 600. The container 600 is substantially the same as container 500, and therefore like reference numerals preceded by the numeral "6" instead of the numerals "1" through "5", are used to indicate like elements. As can be seen, the container 600 includes a tip region 611 having a substantially frusto-conical surface contour for conformably contacting or substantially conformably contacting a user's facial or other skin area, or otherwise for effectively and comfortably applying a released product to a desired area. As may be recognized by those of ordinary skill in the pertinent art based on the teachings herein, the shape of the nozzle tip may take any of numerous different shapes and/or configurations that are currently or later become known for performing the functions of the nozzle tip, including conformably or otherwise contact a particular surface area of interest.

Figure 19:
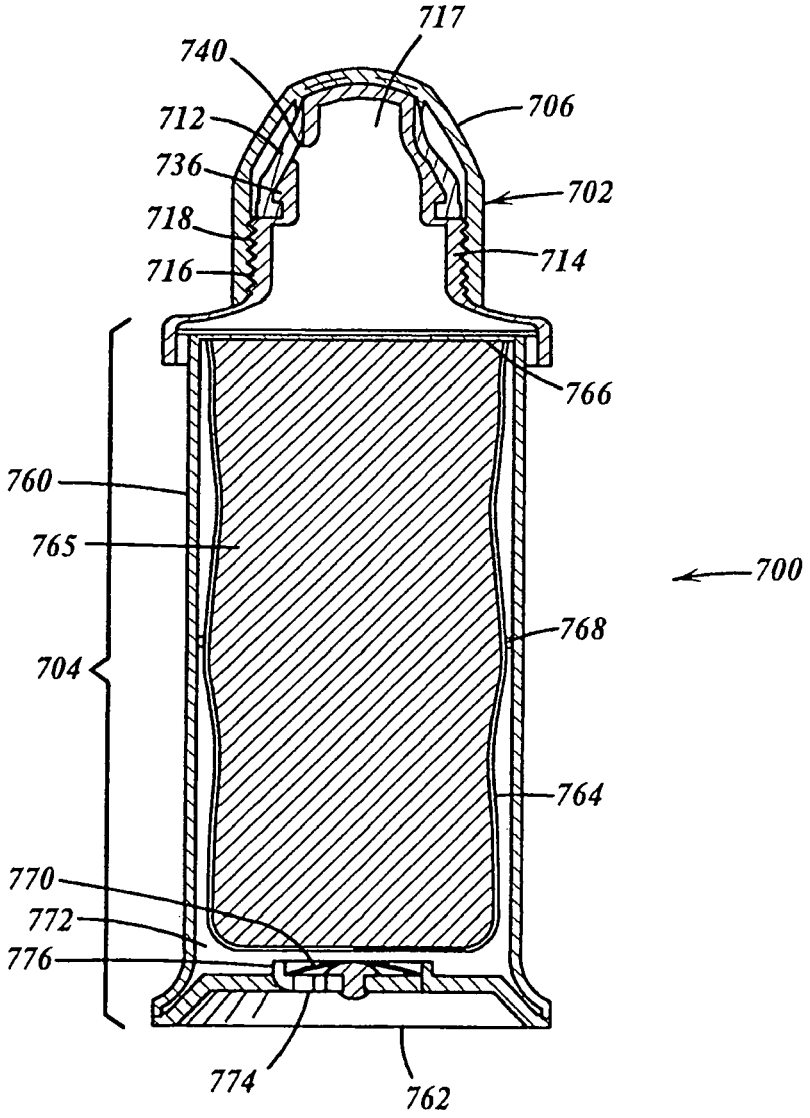
FIG. 19 illustrates a cross-sectional view of another container for storing and releasing a substance from a sterile environment.
Figures 20A, 20B, 20C, 20D:
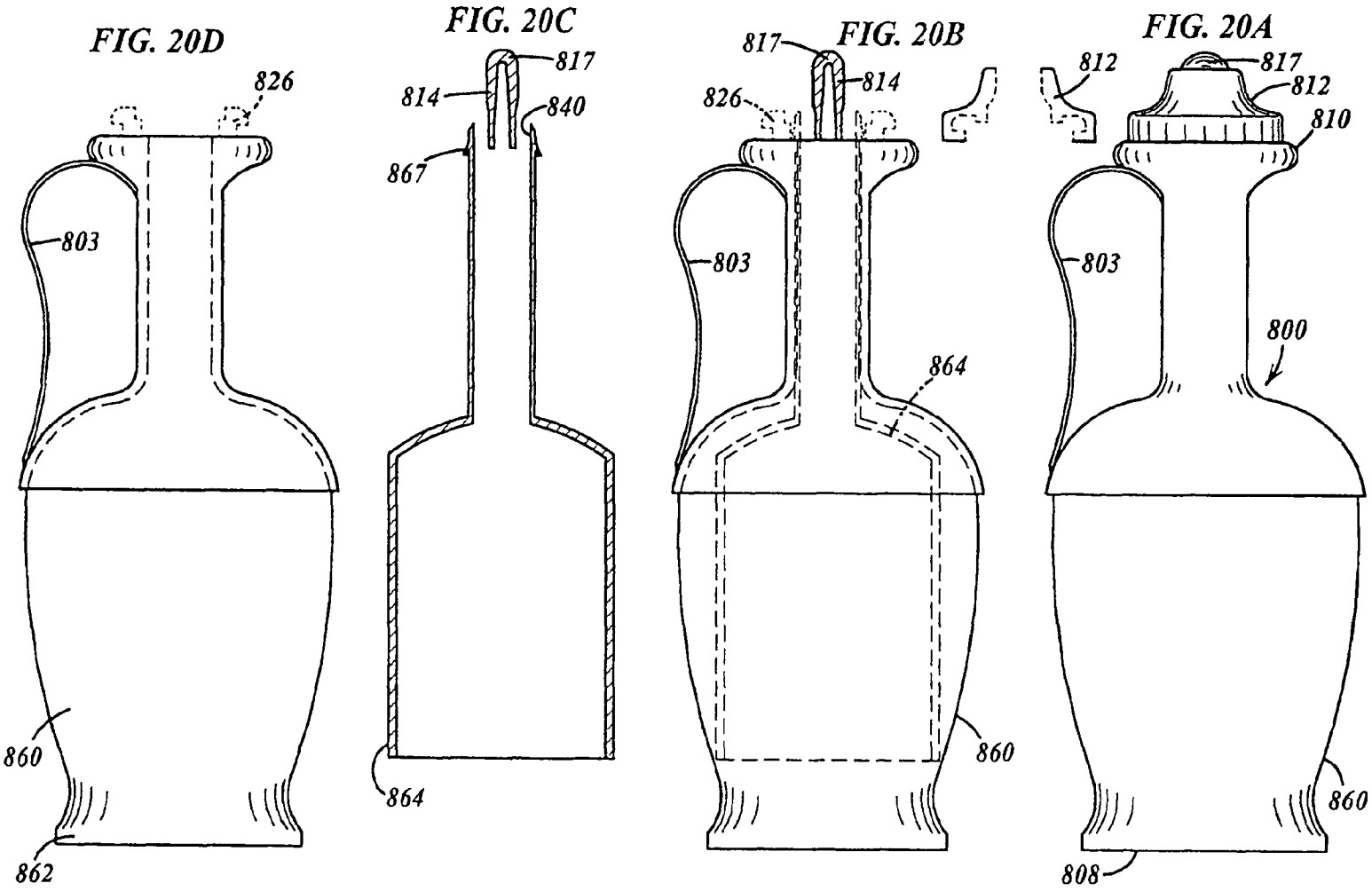
FIG. 20A illustrates a side elevational view of still another container for storing and releasing a substance from a sterile environment.
FIG. 20B illustrates a line drawing of the container of FIG. 20A.
FIG. 20C illustrates the cartridge of the container of FIG. 20A.
FIG. 20D illustrates the outer cover of the container of FIG. 20A.
Figure 21B:
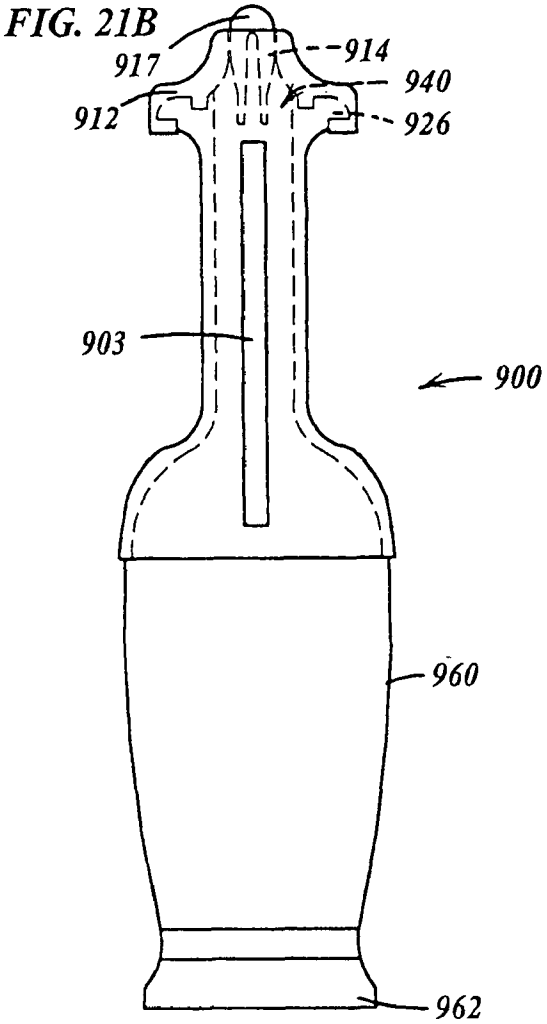
FIG. 21B illustrates a line drawing side view of the container of FIG. 21A.
Figure 21A:
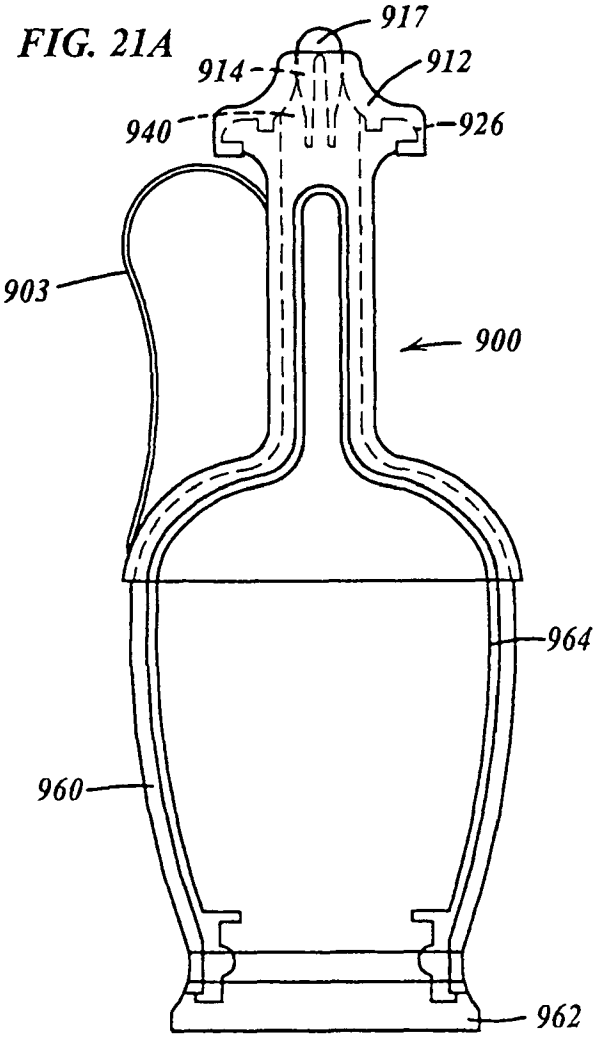
FIG. 21A illustrates a line drawing front view of still another container for storing and releasing a substance from a sterile environment.
Figure 22B:
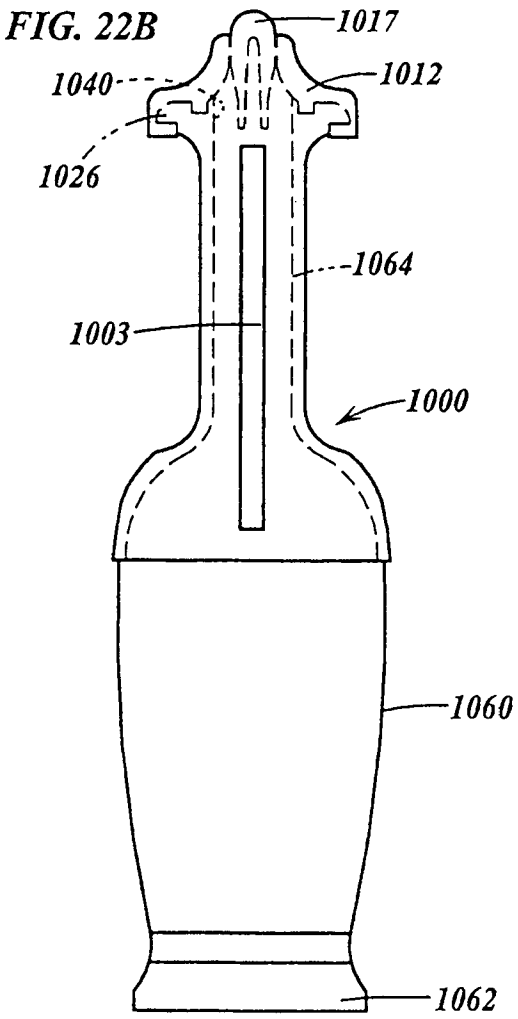
FIG. 22B illustrates a line drawing side view of the container of FIG. 22A.
Figure 22A:
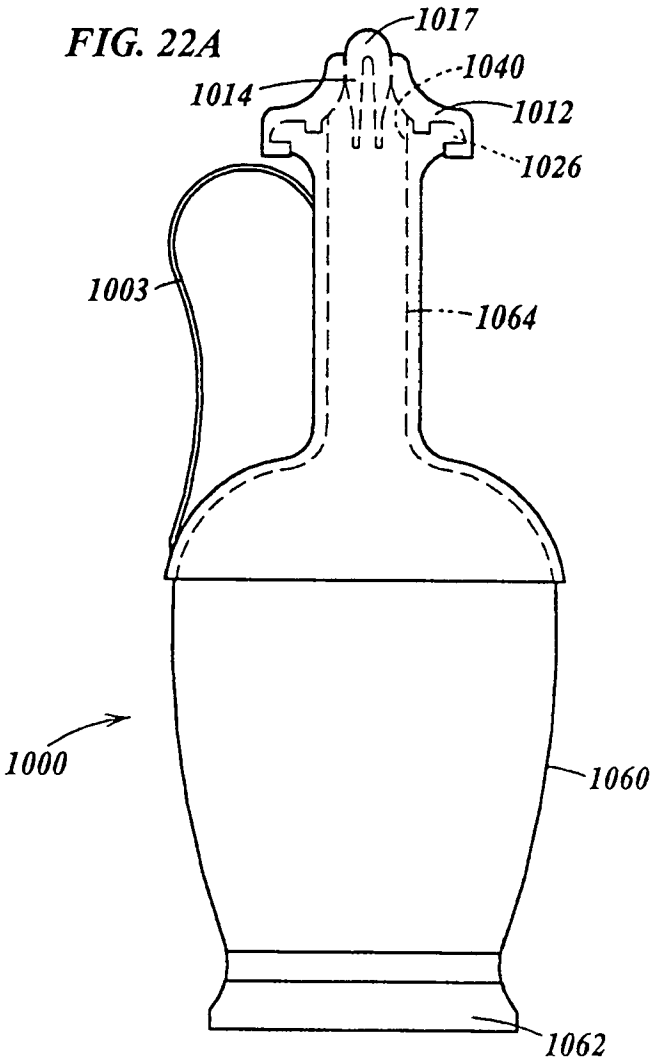
FIG. 22A illustrates a line drawing front view of still another container for storing and releasing a substance from a sterile environment.

In FIG. 19, another container embodiment is indicated generally by the reference numeral 700. The nozzle 702 of container 700 is substantially the same as the nozzles above, and therefore like reference numerals preceded by the numeral "7" instead of the numerals "1" through "6", are used to indicate like elements whenever possible. For simplicity, the following description is directed to the differences in the body 704 of the container 700. The body 704 has a resilient outer wall 760 and base 762 sealingly connected to the lowermost end of the outer wall 760. The outer wall 12 has a cross-section to accommodate a user's hand and is fabricated from a resilient plastic such as low density polyethylene so that the outer wall 112 can be heat sealed to the other components of the container 700. As would be appreciated by those of ordinary skill in the pertinent art molding, extruding and like methods of fabricating the components of container 700 are interchangeable and adhesives, heat sealing, interference fits, the like and combinations thereof may be used to assemble the container 700.

The base 762 is sealed to the lowermost end of the outer wall 760. Preferably, the base 762 is sized and configured such that the container 700 can be rested in an upstanding manner thereon. An air check valve 770 regulates the flow of air to and from the space 772 between the interior of the outer wall 760 and exterior of the inner bag 764. A vent hole 774 in the base 762 admits ambient air into the space 772 via the check valve 770 after a dispensing cycle to allow the outer wall 760 to return to an oval cross-sectional shape. As the container 700 is squeezed, the escape of air from the vent hole 774 needs to be sufficiently slow enough so that pressure builds within space 772 and dispensing occurs before an appreciable amount of air is lost. In contrast, upon relaxation of the squeezing, sufficient air needs to enter into space 772 via vent hole 774 to quickly return the outer wall 760 to the undeformed shape. A ring 776 surrounds the check valve 770 to prevent an inner bag 764 from interfering with the operation of the check valve 770.

The flexible inner bag 764 contains the product and is secured to the outer wall 760 at a top edge 766. In addition, the inner bag 764 is secured to the interior of the outer wall 760 at a point 768 approximately intermediate the ends of the outer wall 760 to insure substantially complete emptying of the inner bag 764 without extraordinary force being applied to the outer wall 760. Preferably, the inner bag 764 is fabricated from a low flexural modulus material to prevent significantly adding to the force required to dispense the product contained within the interior 765 thereof.

The nozzle 702 selectively and hermetically seals the interior of the inner bag 762 from the ambient air. By preventing air from entering into the interior 765 of the inner bag 764, the nozzle 702 not only retains the sterility of the interior 765 but aids in initiating the next dispensing cycle without appreciable belching or excessive squeezing of the outer wall 760. During the dispensing cycle, the outer wall 760 is squeezed and deforms to increase the pressure within the space 772 and thereby increase the pressure within the interior 765 of the inner bag 764. Although an amount of air escapes through vent hole 774, the pressure overcomes the engagement of the valve cover 712 and the product flows out of flow apertures 740 as described above. Upon removal of the squeezing force, dispensing of the product stops. The outer wall 769 begins to return to the undeformed shape which creates a vacuum within space 772. The vacuum forces the check valve 770 to open allowing ambient air to enter via vent hole 774 to, in turn, cause the inner bag to move toward the nozzle 702 and allow the outer wall 760 to return to shape. Accordingly, during subsequent squeezing of the outer wall 760, the nozzle 702 quickly opens again to allow the product to be released again in a hermetic manner. After multiple doses, the inner bag 764 flexes about the midpoint 768 until substantially all of the product is dispensed from the interior 765.

In another embodiment, the outer wall 760 is fabricated from a relatively rigid material to, in turn, increase the pressure required to deform the outer wall 760 and/or facilitate generating pressure. As a result, the nozzle 702 can be configured for an increased opening pressure. It will be appreciated by those of ordinary skill in the art upon review of the subject disclosure that the concepts of container 700 can be readily adapted to any of a number of configurations for containers such as, without limitation, a flexible tube as shown above and the check valve may be located at any of several suitable locations.

In FIGS. 20A-22B, three additional embodiment are indicated generally by the reference numerals 800, 900 and 1000, respectively. The nozzles of these containers are substantially the same as the nozzles above, and therefore like reference numerals preceded by a different numeral instead of the numerals "1" through "7", are used to indicate like elements whenever possible. For simplicity, the following description is directed to the differences in the containers. Turning to container 800 shown in FIGS. 20A-20D, the outer cover 860 is formed into a decorative shape and receives a cartridge 864. Preferably, the cartridge 864 selectively engages the outer cover 860 by a snap fit mechanism 867 and has the inner body 814 formed integrally therewith. A new outer cover 860 may be used each time a cartridge 864 is replaced or the same outer cover 860 may be reused. In another embodiment, the outer cover 860 is a semi-rigid or rigid material such as colored plastic or glass to further add to the aesthetics of the container 800. In another embodiment, the entire outer cover 860 is rigid and a pump is included to dispense the product as shown in U.S. patent application Ser. No. 10/001,745 filed Oct. 23, 2001, now U.S. Pat. No. 6,761,286, which is incorporated herein by reference in its entirety. A handle 803 allows easy carrying and use of the container 800.

By varying the configuration of the nozzle, the valve opening pressure can be optimized to release even highly viscous products such as honey, syrups, lubricating greases, petrogels, caulking compounds and other materials ranging from one centipoise to thousands of centipoise of viscosity while at the same time maintaining the integrity and sterility of the remaining product.

While the invention has been described with respect to preferred embodiments, those skilled in the art will readily appreciate that various changes and/or modifications can be made to the invention without departing from the spirit or scope of the invention as defined by the appended claims.

What is claimed is:

1. A method comprising:

(a) filling with a substance a sterile assembly including a variable-volume storage chamber, and a one-way valve coupled in fluid communication with the variable-volume storage chamber and including an elastic valve member forming a normally closed valve opening, wherein the valve member is movable between a normally closed position, and an open position with at least a segment of the valve member spaced away from the closed position to allow the passage of substance from the variable-volume storage chamber through the valve opening, and configured such that one or more of (a) the energy required to open respective segments of the valve member progressively decreases in a direction from an upstream end toward a downstream end of the valve opening or (b) a segment of the valve member is not spaced away from the closed position substantially throughout any period of dispensing to maintain a hermetic seal between the valve opening and ambient atmosphere;

wherein the filling step comprises:

(i) sterile filling the variable-volume storage chamber with a substance; and (ii) hermetically sealing the substance within the variable-volume storage chamber.

2. A method as defined in claim 1, further comprising the steps of:

(b) dispensing a plurality of different portions of the substance at different points in time from the variable-volume storage chamber through the one-way valve; and (c) maintaining the substance within the variable-volume storage chamber sterile and hermetically sealed with respect to ambient atmosphere throughout steps (ii) and (b).

3. A method as defined in claim 2, further comprising the step of substantially preventing the ingress of bacteria or other unwanted impurities through the one-way valve and into the variable-volume storage chamber during steps (b) and (c).

4. A method as defined in claim 2, wherein steps (b) and (c) are performed at ambient temperature.

5. A method as defined in claim 2, wherein the dispensing step includes pumping a plurality of different portions of the substance at different points in time from the variable-volume storage chamber through the one-way valve.

6. A method as defined in claim 1, wherein a bag defines the variable-volume storage chamber, and further comprising the step of mounting the bag within a rigid or semi-rigid outer container.

7. A method as defined in claim 1, further comprising the step of sterilizing the substance prior to the step of sterile filling the variable-volume storage chamber with the substance.

8. A method as defined in claim 1, wherein the substance is a perishable liquid food that contains one or more of milk, yogurt, baby food, baby formula, mayonnaise, cheese, mustard, ketchup, syrup or a beverage.

9. A method as defined in claim 1, wherein the substance comprises one or more of a cosmetic, a cosmeceutical product, a dermatological product, a pharmaceutical product, a sterile product, a non-preserved product, or a medicament.

10. A device for storing fluid and dispensing multiple portions of the stored fluid therefrom, comprising:

a flexible container defining a hermetically sealed, variable-volume storage chamber containing therein multiple portions of the fluid hermetically sealed within the storage chamber with respect to ambient atmosphere; and a one-way valve comprising a valve member formed of an elastic material and forming a normally closed valve opening and an inlet to the valve opening in fluid communication with the variable-volume storage chamber, wherein the valve member is movable between a normally closed position, and an open position with at least a segment of the valve member spaced away from the closed position to allow the passage of fluid from the variable-volume storage chamber through the valve opening, and configured such that one or more of (a) the energy required to open respective segments of the valve member progressively decreases in a direction from an upstream end toward a downstream end of the valve opening or (b) a segment of the valve member is not spaced away from the closed position substantially throughout any period of dispensing to maintain a hermetic seal between the valve opening and ambient atmosphere;

wherein during dispensing of fluid through the one-way valve, the one-way valve and storage chamber substantially prevent ingress of air and maintain any remaining fluid in the storage chamber sealed with respect to ambient atmosphere.

11. A device as defined in claim 10, further comprising a rigid or semi-rigid outer body for receiving therein the flexible container.

12. A device as defined in claim 10, wherein the fluid comprises perishable food product.

13. A device as defined in claim 10, wherein the fluid comprises a beverage.

14. A device as defined in claim 10, further comprising a squeezable tubular portion coupled in fluid communication between the storage chamber and the one way valve.

15. A device as defined in claim 14, further comprising a pump configured to squeeze the squeezable tubular portion.

16. A device as defined in claim 10, further comprising a pump configured to pump fluid from the storage chamber through the valve opening.

17. A device as defined in claim 10, wherein the flexible container comprises a bag.

18. A method as defined in claim 10, wherein the fluid comprises one or more of a cosmetic, a cosmeceutical product, a dermatological product, a pharmaceutical product, a sterile product, a non-preserved product, or a medicament.

19. A valve assembly that is connectable to a tube for dispensing a substance therefrom, the tube including a squeezable tubular body defining therein a tubular chamber for receiving and dispensing the substance therefrom, and a portion located at one end of the tubular body and connectable to the valve assembly, wherein the tubular body defines a first axially extending passageway forming an unobstructed axially extending flow path therethrough, the valve assembly comprising:

(a) a valve body connectable to the tube and including:

a body base defining a second axially extending passageway connectable in fluid communication with the first axially extending passageway and defining an unobstructed axially extending flow path therebetween;

an axially extending valve seat defining a diameter less than a diameter of the body base;

a first substantially tapered portion extending between the body base and the valve seat;

and at least one flow aperture axially extending in a direction of an axis of the valve assembly through the substantially tapered portion adjacent to the valve seat; and (b) a valve cover formed of an elastic material defining a predetermined modulus of elasticity, and including:

a cover base mounted on the body base and fixedly secured against axial movement relative thereto, wherein the cover base defines a diameter less than a diameter of the body base to thereby form an interference fit therebetween;

a valve portion overlying the valve seat, wherein the valve portion defines a predetermined radial thickness and a diameter less than a diameter of the valve seat to thereby form an interference fit therebetween, the valve portion and valve seat defining a normally closed, axially extending valve opening therebetween, and the valve portion is movable between a normally closed position with the valve portion engaging the valve seat and an open position with a segment of the valve portion spaced away from the valve seat to allow the passage of substance at a predetermined valve opening pressure therebetween; and a second substantially tapered portion extending between the cover base and valve portion, overlying the first substantially tapered portion of the body, and forming an interference fit therebetween; and wherein (a) one or more of i) the valve seat diameter, ii) a degree of interference between the valve cover and valve seat, iii) the predetermined radial thickness of the valve portion, or iv) a predetermined modulus of elasticity of the valve cover material, is selected to (1) define a predetermined valve opening pressure generated upon squeezing the tube that allows passage of the substance from the storage chamber through the valve opening, and (2) hermetically seal the valve and prevent the ingress of bacteria through the valve and into the tube in the normally closed position, and (b) the valve cover and valve body define a progressively decreasing degree of interference along the valve opening in a direction from the interior to the exterior of the valve assembly.

20. A method comprising:

aseptically storing substance in and dispensing substance from an internally sterile assembly including a variable-volume storage chamber, and a one-way valve coupled in fluid communication with the variable-volume storage chamber and including an elastic valve member forming a normally closed valve opening, wherein the valve member is movable between a normally closed position, and an open position with at least a segment of the valve member spaced away from the closed position to allow the passage of substance from the variable-volume storage chamber through the valve opening, and configured such that one or more of (a) the energy required to open respective segments of the valve member progressively decreases in a direction from an upstream end toward a downstream end of the valve opening or (b) a segment of the valve member is not spaced away from the closed position substantially throughout any period of dispensing to maintain a hermetic seal between the valve opening and ambient atmosphere; the steps of storing and dispensing including (i) sterile filling the variable-volume storage chamber with a substance;

(ii) hermetically sealing the substance within the variable-volume storage chamber;

(iii) dispensing a plurality of different portions of the substance at different points in time from the variable-volume storage chamber through the one-way valve; and (iv) maintaining the substance within the variable-volume storage chamber sterile and hermetically sealed with respect to ambient atmosphere throughout steps (ii) and (iii).

21. A method as defined in claim 20, further comprising the step of substantially preventing the ingress of bacteria or other unwanted impurities through the one-way valve and into the variable-volume storage chamber during steps (iii) and (iv).

22. A method as defined in claim 20, wherein the dispensing step includes pumping a plurality of different portions of the substance at different points in time from the variable-volume storage chamber through the one-way valve.

23. A method as defined in claim 20, wherein a bag defines the variable-volume storage chamber, and further comprising the step of mounting the bag within a rigid or semi-rigid outer container.

24. A method as defined in claim 20, further comprising the step of sterilizing the substance prior to the step of sterile filling the variable-volume storage chamber with the substance.

25. A method as defined in claim 20, wherein the substance is a perishable liquid food that contains one or more of milk, yogurt, baby food, baby formula, mayonnaise, cheese, mustard, ketchup, syrup or a beverage.

26. A method as defined in claim 20, wherein steps (iii) and (iv) are performed at ambient temperature.

27. A method as defined in claim 20, wherein the substance comprises one or more of a cosmetic, a cosmeceutical product, a dermatological product, a pharmaceutical product, a sterile product, a non-preserved product, or a medicament.

28. A device for aseptically storing and dispensing a substance, comprising:

an assembly including a variable-volume storage chamber, and a one-way valve coupled in fluid communication with the variable-volume storage chamber and including an elastic valve member forming a normally closed valve opening, wherein the valve member is movable between a normally closed position, and an open position with at least a segment of the elastic valve member spaced away from the closed position to allow the passage of substance from the variable-volume storage chamber through the valve opening, and configured such that one or more of (a) the energy required to open respective segments of the valve member progressively decreases in a direction from an upstream end toward a downstream end of the valve opening or (b) a segment of the valve member is not spaced away from the closed position substantially throughout any period of dispensing to maintain a hermetic seal between the valve opening and ambient atmosphere, and wherein the variable-volume storage chamber is sterile filled with a substance, the substance is hermetically sealed in the variable-volume storage chamber, and the assembly maintains the substance within the variable-volume storage chamber sterile and hermetically sealed with respect to ambient atmosphere throughout dispensing a plurality of different portions of the substance from the storage chamber through the one-way valve.

29. A device as defined in claim 28, further comprising a bag that defines the variable-volume storage chamber and a rigid or semi-rigid outer container, wherein the bag is received within the rigid or semi-rigid outer container.

30. A device as defined in claim 28, further comprising a pump for pumping a plurality of different portions of the substance from the variable-volume storage chamber through the one-way valve.

31. A device as defined in claim 28, wherein the substance is a perishable liquid food that contains one or more of milk, yogurt, baby food, baby formula, mayonnaise, cheese, mustard, ketchup, syrup or a beverage.

32. A method as defined in claim 28, wherein the substance comprises one or more of a cosmetic, a cosmeceutical product, a dermatological product, a pharmaceutical product, a sterile product, a non-preserved product, or a medicament.

33. A container for aseptically storing fluid and dispensing multiple portions of the stored fluid therefrom, comprising:

a flexible container defining a hermetically sealed, variable-volume storage chamber containing therein multiple portions of fluid in an aseptic condition and hermetically sealed within the storage chamber with respect to ambient atmosphere;

a one-way valve comprising a valve member formed of an elastic material and forming a normally closed valve opening and an inlet to the valve opening in fluid communication with the variable-volume storage chamber, wherein the valve member is movable in response to fluid at the inlet to the valve opening exceeding a valve opening pressure between (i) a normally closed position and (ii) an open position with at least a segment of the valve member spaced away from the closed position to allow fluid from the variable-volume storage chamber to be dispensed through the valve opening, and configured such one or more of (a) the energy required to open respective segments of the valve member progressively decreases in a direction from an upstream end toward a downstream end of the valve opening or (b) a segment of the valve member is not spaced away from the closed position substantially throughout any period of dispensing to maintain a hermetic seal between the valve opening and ambient atmosphere, and wherein during dispensing of fluid through the one-way valve, the one-way valve and storage chamber maintain any remaining fluid in the storage chamber in an aseptic condition and sealed with respect to ambient atmosphere.

34. A container as defined in claim 33, further comprising a pump coupled between the variable-volume storage chamber and one-way valve and configured to pump fluid from the storage chamber and into the valve opening to dispense the fluid therethrough.

35. A container as defined in claim 33, further comprising a tubular portion coupled in fluid communication between the variable-volume storage chamber and one-way valve.

36. A container as defined in claim 33, wherein the one-way valve further includes a valve body defining a valve seat, wherein the elastic valve member includes a valve portion overlying the valve seat and covering a substantial portion thereof, the valve portion forms an interference fit with the valve seat, the valve portion and the valve seat define a seam therebetween forming the valve opening, and the valve portion engages the valve seat in the closed position.

37. A container as defined in claim 36, wherein the valve portion includes a segment that engages the valve seat substantially throughout any period of dispensing fluid through the valve opening to maintain a hermetic seal between the valve opening and ambient atmosphere.

38. A container as defined in claim 36, wherein one or more of (i) the valve portion and valve seat define a progressively decreasing degree of interference therebetween in a direction from an upstream end toward downstream end of the valve opening, (ii) the valve portion defines a decreasing radial thickness when moving axially in a direction from an upstream end toward a downstream end of the valve seat, or (iii) the valve seat is defined by a radius that progressively increases in magnitude in a direction from an upstream end toward a downstream end of the valve seat.

39. A container as defined in claim 36, wherein the valve body defines a flow aperture extending through one or more of the valve body or the valve seat, and wherein the valve seat, the valve portion and the seam are axially-extending.

40. A container as defined in claim 33, wherein the fluid is a liquid food product selected from the group including milk, yogurt, baby food, baby formula, mayonnaise, cheese, mustard, ketchup, syrup and a beverage.

41. A container as defined in claim 40, wherein the liquid food product is sterile and preservative free.

42. A container as defined in claim 3, further comprising an airflow passageway connectable in fluid communication between the exterior and interior of the outer body for regulating a flow of air into the outer body between the outer body and flexible container, and the outer body is manually squeezable to compress the air located between the outer body and flexible container to compress the container and, in turn, compress the fluid within the flexible container to a pressure exceeding the valve opening pressure.

43. A container as defined in claim 33, wherein the variable-volume storage chamber stores the fluid therein in a substantially airless condition during shelf life and dispensing of fluid through the one-way valve.

44. A method as defined in claim 33, wherein the fluid comprises one or more of a cosmetic, a cosmeceutical product, a dermatological product, a pharmaceutical product, a sterile product, a non-preserved product, or a medicament.

45. A method for aseptically storing fluid and dispensing multiple portions of the stored fluid therefrom, comprising the following steps:

providing a flexible container defining a hermetically sealed, variable-volume storage chamber containing therein multiple portions of fluid in an aseptic condition and hermetically sealed within the storage chamber with respect to ambient atmosphere;

providing a rigid or semi-rigid outer body and receiving therein the flexible container;

providing a one-way valve comprising a valve member formed of an elastic material and forming a normally closed valve opening and an inlet to the valve opening in fluid communication with the variable-volume storage chamber;

pressurizing fluid at the inlet to the valve opening to a pressure at least equal to a valve opening pressure and moving the elastic valve member between (i) a normally closed position and (ii) an open position with at least a segment of the valve member spaced away from the closed position, and, in turn, dispensing fluid from the variable-volume storage chamber through the valve opening; and during dispensing of fluid through the one-way valve, maintaining any remaining fluid in the storage chamber in an aseptic condition and sealed with respect to ambient atmosphere;

wherein the step of providing the one-way valve includes providing the one-way valve with a configuration such that one or more of (a) the energy required to open respective segments of the valve member progressively decreases in a direction from an upstream end toward a downstream end of the valve opening or (b) a segment of the valve member is not spaced away from the closed position substantially throughout any period of dispensing to maintain a hermetic seal between the valve opening and ambient atmosphere.

46. A method as defined in claim 45, further comprising the step of pumping fluid from the storage chamber and into the valve opening to dispense the fluid therethrough.

47. A method as defined in claim 45, wherein the fluid is a liquid food product selected from the group including milk, yogurt, baby food, baby formula, mayonnaise, cheese, mustard, ketchup, syrup and a beverage.

48. A method as defined in claim 45, wherein the fluid comprises one or more of a cosmetic, a cosmeceutical product, a dermatological product, a pharmaceutical product, a sterile product, a non-preserved product, or a medicament.

49. A method comprising:

storing fluid in a device comprising (i) a flexible container defining a hermetically sealed, variable-volume storage chamber containing therein multiple portions of the fluid hermetically sealed within the storage chamber with respect to ambient atmosphere and (ii) a one-way valve comprising (a) a valve member formed of an elastic material and forming a normally closed valve opening, wherein the valve member is movable between a normally closed position, and an open position with at least a segment of the valve member spaced away from the closed position to allow the passage of fluid from the variable-volume storage chamber through the valve opening, and configured such that one or more of (I) the energy required to open respective segments of the valve member progressively decreases in a direction from an upstream end toward a downstream end of the valve opening or (II) a segment of the valve member is not spaced away from the closed position substantially throughout any period of dispensing to maintain a hermetic seal between the valve opening and ambient atmosphere, and (b) an inlet to the valve opening in fluid communication with the variable-volume storage chamber; and dispensing at least one of the multiple portions of the stored fluid, the dispensing step comprising:

pressurizing fluid at the inlet to the valve opening to a pressure at least equal to a valve opening pressure and moving the elastic valve member between (i) a normally closed position and (ii) an open position with at least a segment of the valve member spaced away from the closed position, and, in turn, dispensing fluid through the valve opening; and during dispensing of fluid through the one-way valve, substantially preventing ingress of air and thereby maintaining any remaining fluid in the storage chamber sealed with respect to ambient atmosphere.

50. A method as defined in claim 49, wherein the maintaining step includes substantially preventing ingress of air into the storage chamber.

51. A method as defined in claim 49, wherein the device further comprises a rigid or semi-rigid outer body for receiving therein the flexible container.

52. A method as defined in claim 49, wherein the fluid comprises perishable food product.

53. A method as defined in claim 49, wherein the fluid comprises a beverage.

54. A method as defined in claim 49, wherein the device further comprises a squeezable tubular portion coupled in fluid communication between the storage chamber and the one way valve.

55. A method as defined in claim 54, wherein the pressurizing step comprises squeezing the squeezable tubular portion.

56. A method as defined in claim 54, wherein the device further comprises a pump configured to squeeze the squeezable tubular portion.

57. A method as defined in claim 49, wherein the device further comprises a pump configured to pressurize fluid at the inlet to the valve opening to dispense the fluid therethrough.

58. A method as defined in claim 57, wherein the pressurizing step comprises activating the pump.

59. A method as defined in claim 49, wherein the flexible container comprises a bag.

60. A method as defined in claim 49, wherein the fluid comprises one or more of a cosmetic, a cosmeceutical product, a dermatological product, a pharmaceutical product, a sterile product, a non-preserved product, or a medicament.

61. A method comprising the following steps:

(a) aseptically storing fluid in a device comprising a flexible container defining a hermetically sealed, variable-volume storage chamber containing therein multiple portions of the fluid in an aseptic condition and hermetically sealed within the storage chamber with respect to ambient atmosphere; a rigid or semi-rigid outer body and receiving therein the flexible container; and a one-way valve comprising a valve member formed of an elastic material and forming a normally closed valve opening and an inlet to the valve opening in fluid communication with the variable-volume storage chamber;

(b) pressurizing fluid at the inlet to the valve opening to a pressure at least equal to a valve opening pressure and moving the elastic valve member between (i) a normally closed position and (ii) an open position with at least a segment of the valve member spaced away from the closed position, and, in turn, dispensing fluid from the variable-volume storage chamber through the valve opening; and (c) during dispensing of fluid through the one-way valve, maintaining any remaining fluid in the storage chamber in an aseptic condition and sealed with respect to ambient atmosphere;

wherein the one way valve is configured such that one or more of (a) the energy required to open respective segments of the valve member progressively decreases in a direction from an upstream end toward a downstream end of the valve opening or (b) a segment of the valve member is not spaced away from the closed position substantially throughout any period of dispensing;

and further performing the step of maintaining a hermetic seal between the valve opening and ambient atmosphere during said dispensing step.

62. A method as defined in claim 61, further comprising the step of pumping fluid from the storage chamber and into the valve opening to dispense the fluid therethrough.

63. A method as defined in claim 61, wherein the fluid is a liquid food product selected from the group including milk, yogurt, baby food, baby formula, mayonnaise, cheese, mustard, ketchup, syrup and a beverage.

64. A method as defined in claim 61, wherein the fluid comprises one or more of a cosmetic, a cosmeceutical product, a dermatological product, a pharmaceutical product, a sterile product, a non-preserved product, or a medicament.

65. A device for storing fluid and dispensing stored fluid therefrom, comprising:

a manually squeezable body containing a storage chamber therein;

a fluid within the storage chamber;

a one-way valve comprising a valve seat and a valve member formed of an elastic material overlying the valve seat and forming a normally closed valve opening therewith defined by a seam between the valve seat and the valve member and defining a valve opening pressure, and an inlet to the valve opening in fluid communication with the storage chamber, wherein the valve member is movable between a normally closed position in which the valve member engages the valve seat, and an open position with at least a segment of the valve member spaced away from the closed position to allow passage of at least a portion of fluid from the storage chamber through the valve opening, and configured such that substantially throughout any period of dispensing the one-way valve substantially prevents the ingress of bacteria or other unwanted impurities from the ambient atmosphere through the one-way valve and into the storage chamber;

wherein one or more of (a) the valve member and the valve seat define a progressively decreasing degree of interference along the valve opening in a direction from the interior to the exterior of the one way valve, (b) the energy required to open respective segments of the valve member progressively decreases in a direction from an upstream end toward a downstream end of the valve opening or (c) a segment of the valve member is not spaced away from the closed position substantially throughout any period of dispensing to maintain a hermetic seal between the valve opening and ambient atmosphere; and an airflow passageway in fluid communication between an exterior and an interior of the manually squeezable body for regulating a flow of air into the interior of the body, wherein bacteria and unwanted impurities in air passing through the airflow passageway are substantially prevented from contaminating the fluid in the storage chamber;

wherein upon manually squeezing the manually squeezable body, fluid at the inlet to the valve opening is pressurized to a pressure at least equal to the valve opening pressure and moving the elastic valve member between the normally closed position and the open position with at least a segment of the valve member spaced away from the closed position, and, in turn, dispensing at least a portion of the stored fluid through the valve opening; and wherein upon relaxation of the squeezing, air enters the interior of the manually squeezable body through the airflow passageway without bacteria and unwanted impurities in said air contaminating the fluid in the storage chamber.

66. A device as defined in claim 65, wherein the one-way valve further includes a valve body and a flow aperture extending through the valve body, the flow aperture placing the storage chamber in fluid communication with the inlet to the valve.

67. A device as defined in claim 65, wherein the valve seat, the valve member and the seam are axially-extending.

68. A device as defined in claim 65, wherein the fluid is one or more of sterile and non-preserved.

* * * * *